US010238155B2

(12) United States Patent
Braverman

(10) Patent No.: US 10,238,155 B2
(45) Date of Patent: Mar. 26, 2019

(54) BRA ENGINEERING

(71) Applicant: Laurie Braverman, New York, NY (US)

(72) Inventor: Laurie Braverman, New York, NY (US)

( * ) Notice: Subject to any disclaimer, the term of this patent is extended or adjusted under 35 U.S.C. 154(b) by 473 days.

(21) Appl. No.: 14/957,420

(22) Filed: Dec. 2, 2015

(65) Prior Publication Data

US 2017/0156413 A1 Jun. 8, 2017

(51) Int. Cl.

| | |
|---|---|
| ***A41C 3/10*** | (2006.01) |
| ***A41C 3/00*** | (2006.01) |
| ***A41C 3/06*** | (2006.01) |
| ***A41C 5/00*** | (2006.01) |
| *A41C 3/14* | (2006.01) |

(52) U.S. Cl.

CPC ..... *A41C 3/10* (2013.01); *A41C 3/0007* (2013.01); *A41C 3/0092* (2013.01); *A41C 3/06* (2013.01); *A41C 5/00* (2013.01); *A41C 3/144* (2013.01)

(58) Field of Classification Search

CPC ..... A41C 3/005; A41C 3/0092; A41C 3/10; A41C 3/14; A41C 3/142; A41C 3/144; A41C 3/146; A41C 3/148

USPC ..... 450/54, 55, 56, 57

See application file for complete search history.

(56) References Cited

U.S. PATENT DOCUMENTS 2,734,193 A * 2/1956 Croxall ..... A41C 3/0021 450/63
4,393,875 A 7/1983 o'Boyle
5,098,330 A * 3/1992 Greenberg ..... A41C 3/10 450/31
5,485,855 A 1/1996 Shiriwara
6,015,332 A * 1/2000 Lee ..... A41C 3/144 450/38
6,080,037 A * 6/2000 Lee ..... A41C 3/105 2/67
6,101,630 A * 8/2000 Lee ..... A41C 3/0028 2/57

(Continued)

FOREIGN PATENT DOCUMENTS

WO WO13/144264 10/2013
WO WO14/089167 6/2014

OTHER PUBLICATIONS

Search Report issued in International Bureau of WIPO Patent Application No. PCT/US16/64471, dated Feb. 16, 2017.

(Continued)

*Primary Examiner* — Gloria Hale
(74) *Attorney, Agent, or Firm* — Greenblum & Bernstein, P.L.C.

(57) ABSTRACT

A brassiere includes a first wing and a second wing, each wing including a first end and a second end; a closure; a pair of cups, each cup including an inner contour having a diameter size; each cup including an outer contour having an outer diameter having an outer diameter size, and an outer apex having a projection distance from the plane of the outer diameter; filling material provided between the inner contour and the outer contour; and a gore connected to each of the first cup and the second cup, between the first cup and the second cup, in which the cup diameter size and outer apex projection distance provide a brassiere with improved function and comfort.

6 Claims, 29 Drawing Sheets

(56) References Cited

U.S. PATENT DOCUMENTS 6,302,760 B1 * 10/2001 Dai ..... A41C 3/105 450/38
6,354,906 B1 * 3/2002 Liu ..... A41C 3/105 2/267
6,431,945 B1 * 8/2002 Stephens ..... A41C 3/10 450/37
6,916,224 B2 * 7/2005 Chen ..... A41C 3/065 450/57
7,618,304 B2 * 11/2009 Chen ..... A41C 3/146 450/36
7,871,305 B2 * 1/2011 Cohen ..... A41C 3/0028 450/54
8,753,169 B2 * 6/2014 Redenius ..... A41C 3/0028 450/59
8,821,210 B2 * 9/2014 Solotoff ..... A41C 3/10 450/63
8,956,199 B2 * 2/2015 Liu ..... A41C 3/146 450/38
9,011,199 B2 * 4/2015 Yuasa ..... A41C 3/14 450/53
2006/0259179 A1 11/2006 Petterson
2006/0281390 A1 * 12/2006 Lin ..... A41C 3/0092 450/57
2007/0082579 A1 4/2007 Baran
2009/0215359 A1 8/2009 Chapman
2010/0015886 A1 * 1/2010 Waitz ..... A41C 3/10 450/39
2010/0041313 A1 * 2/2010 Castellano ..... A41C 3/144 450/39
2010/0242291 A1 * 9/2010 Ohly ..... A41C 3/00 33/17 R
2010/0273395 A1 * 10/2010 Castellano ..... A41C 3/144 450/39
2011/0287691 A1 * 11/2011 Hu ..... A41C 3/10 450/56
2012/0149278 A1 * 6/2012 Liu ..... A41C 3/144 450/57
2012/0135667 A1 7/2012 Chan
2012/0184180 A1 * 7/2012 Hu ..... A41C 3/10 450/55
2013/0095728 A1 4/2013 Sculpted
2013/0109276 A1 * 5/2013 Sporn ..... A41C 3/10 450/57
2014/0154947 A1 * 6/2014 Braverman ..... A41C 3/10 450/41
2015/0087203 A1 * 3/2015 Turlan-Van Der Hoeven ..... A41C 3/10 450/93
2015/0089824 A1 * 4/2015 Moore ..... A41H 1/02 33/512
2015/0320122 A1 * 11/2015 Hirakubo ..... A41C 3/14 450/55
2016/0029706 A1 * 2/2016 Braverman ..... A41C 3/0092 450/55
2016/0165964 A1 * 6/2016 West ..... A41C 3/0007 450/53
2016/0286879 A1 * 10/2016 Farmer ..... A41B 17/00
2017/0156413 A1 * 6/2017 Braverman ..... A41C 3/10

OTHER PUBLICATIONS

Emma Scott, "The Bra Fitting Bible".
Shin, "The Origins and Evolution of the Bra" Jan. 2009.
"Brassiere" Wikipedia, Feb. 14, 2014.
"How to Make a Bra 1 & 2 Pattern School" Jul. 3, 2012.
Bra Sizing and Underwires Jun. 28, 2012.
Breast Shape, Bra Shape Jul. 14, 2012.
Bra Cup Block, AA/AAA Cup Block, Bra Band Block Jul. 15, 2012.
Rong, Breast Sizing and Development of 3D Seamless Bra.
Breast Base is a Circle Bulk is a Cone Jul. 3, 2012.
"Wires 101", The Lingerie Addict Blog, Aug. 18, 2014.
"Brassiere Measurement" Wikipedia webpage, May 13, 2011.
"Her Room" webpage, Jun. 28, 2012.
Zhou Jie, "New Methods of Evaluating Breast Motion in Braless and Sports Conditions".
PCT Search Report and IPER in PCT/US2016/064471 (29 pages).

* cited by examiner

A = Sphere Diameter

A = Breast Mound Diameter $$A = \frac{\text{Length Over Mound} \times 2}{3.14}$$

B = Half Sphere Circumference

B = Distance Over Mound $$B = \frac{\text{Breast Mound Diameter} \times 3.14}{2}$$

Style: All

Style: Full Cup (Bandeau)

Style: Full Cup (Bandeau)

SVC with polynomial (degree 3) kernel

Style: Full Cup (Bandeau)

Style: Full Cup (Bandeau)

Style: Full Cup (Bandeau)

Style: Full Cup (Bandeau)

Style: Plunge

Style: Plunge

Style: Misc Day Bra

Style: Misc Day Bra

Style: Misc Day Bra

Style: All

Style: All

BRA ENGINEERING

CROSS-REFERENCE TO RELATED APPLICATION

The entire disclosures of U.S. patent application Ser. No. 13/839,566, filed Mar. 15, 2013, and Ser. No. 14/295,714, filed Jun. 4, 2014, including the specification, drawings, and claims, are incorporated herein by reference in their entireties.

BACKGROUND OF THE INVENTION

1. Field of the Invention

The present invention relates to the field of bras, particularly to bra engineering.

2. Background Information

The bra sizing system currently used in ready to wear consists of two measurements; the circumference of the ribcage, and cup size.

Normally production samples are made for size 34B/75B, the difference between the ribcage and full bust circumference determines cup size.

In "The Bra Fitting Bible", Emma Scott teaches "The goal with any cup sizing predicting method is to determine the volume of breast tissue such that it could be assigned a standardized cup letter. Cup letter is a description of how a semi-circular mound of breast tissue, of a set volume appears in size relative to a ribcage, of a set girth that it is attached to. The malleable nature of breast tissue makes calculating an accurate breast mound volume difficult. The average ribcage method of calculating cup size measures the breast inclusively with the ribcage and then calculates the breast protrusion by subtracting the ribcage measurement from the total bust measurement. The over breast method of calculating cup size measures the protrusion of each individual breast. By relating the measured protrusion of a breast to establish mathematical rules regarding spheres, breast attributes can be assigned to a breast mound if it is modeled as a half sphere.

The theory behind bra sizing is grounded on the premise that measurements that are taken from a breast can be used to create a spherical breast mound model, knowing that breast tissue is malleable and will be able to take on a spherical form.

A semi-circular shape is the most accurate way to analyze a multitude of breast tissue volumes across a population and then categorize them into sizes so that a ready to wear sizing system is even possible. Even though a good percentage of breasts are not naturally spherical in nature, this is an aesthetic shape that most breast tissue can be gathered and manipulated into. For the purpose of calculating bra size, the breasts are regarded as two half spheres sitting on a ribcage.

If the over breast measurement is adjusted so that the breast model is spheroid rather than the original sphere, the mathematical calculations will be different from those presented below. It is not necessary to discuss the mathematical relationships of spheroids in this text but it is important to note such calculations do exist.

The spread of the breast mound is limited by the chest width between the armholes. The base half sphere model of breast mound can grow radially only to the point of the arm hole. At this point the base of the sphere can no longer spread and all growth must be manipulated forward and away from the armholes. Extremely large breasts will have too much volume for the standard sphere model of bra cup. Although the sphere model is suitable for calculating volume, it does not reflect the shape that a cup is forced to take on when the volume increases beyond the limits of the upper body. Once the base cup has expanded to the full extent of the upper body width, the remaining cup sizes will share the largest available base. From this point on the cups will begin to be less half sphere like as their base diameter remains the same while the volume continues to grow.

The chart below details the core attributes of breast mound spread and protrusion that is relevant to bra sizing.

Mathematical Relationships of a Circle:

1. Circumference=3.14×Diameter
2. Diameter=Circumference÷3.14
3. Radius=Circumference÷6.28
4. Radius=Breast Mound protrusion
5. Breast Mound Diameter=Distance Over Mound×2÷3.14 Calculates the Base Spread or the Diameter of the Breast Mound
6. Breast Protrusion=Distance Over Mound÷6.28 Calculates Breast Mound Protrusion
7. Volume=0.26×Diameter
8. Cup Volume=0.26×Breast Mound Diameter×Breast Mound Diameter×Breast Mound Diameter Because we know the breast model is a half sphere, certain characteristics can be mathematically calculated. For example, if we know the diameter of a circle we can use a formula to calculate the circle's circumference. Likewise, if we are aware of the circumference of a circle we can calculate the diameter or the radius. In relationship to a breast mound, if we know the distance over the mound we can calculate the spread or diameter of the breast mound, or the protrusion of the breast mound. Most importantly, if we know the distance over the breast mound, we can calculate the diameter of the mound and if we know the diameter of the mound we can calculate the volume.

See FIG. 20 Breast Mound Spread and Protrusion.

The lettered labeling system for bra cup is based on breast tissue being gathered into a semi spherical shape so that mathematical attributes can be determined. The half sphere is important as a mathematical model for volume calculation. The circle is therefore a key geometric shape in bra design. Bra cups gather and collect breast tissue into predetermined semi-circular base and protrusion mounds applicable to a specific cup size for a given band. Breast tissue volume is labeled relative to the chest cavity it is sitting on. A breast volume of 500 ml or 2 cups will appear large on a ribcage that measures 61 cm or 24 inches and be labeled a 28F. That same volume will not appear as large on a 81 cm or 32 inch ribcage and will be labeled a 36B. To fully understand bra sizing it must be understood that it is neither volume nor bust circumference that dictates cup size.

Since there are no definitive industry standards for cup size and volume, volumes are considered to reflect an average range for standard bra sizes, and may differ slightly from product line to product line. The theory of size change however, is the same across the lingerie industry. Identical breast tissue volumes on different ribcage frames are labelled differently and are called sister sizes. Any volume of breast tissue will have a multitude of cup sizes that it could technically fill, but only three of these cups will be on a band that comes "close" to "fitting" and only one of the band and cup combinations will be the correct bra size."

Industry bras are designed to contain the breast tissue by approximating volume and using a tight breast root diameter trace and around the body measurement to support the breasts.

From "The Origins and Evolution of the Bra" by Shin;

"In addition to breast measurements, the breast root can be defined as the crease line where the breast forms on the chest. Every women's breast root are unique and it is essential that the wire curve is matched with the breast root otherwise the wire will create discomfort. However matching the right shape for the individual customers is largely impossible to mass production practice. A good fit bra which is comfortable, uplifting and supporting simultaneously depends on finding a wire which closely matches the shape of the breast root of the wearer.

The development of the pattern drafting system is considered one of the key elements of the development of ready to wear clothing in the 19th century. Godley 1997 emphasizes that the original force behind the development of ready to wear clothing is not the invention of the sewing machine, but the development of standard sizes. In elaboration of Godleys point, Aldrich (2000) identifies three important factors in this development:

The standardization of measurements;

The improvement of pattern drafting; and

The adoption of a grading system.

As a consequence, the development of a basic block for faster production among tailor was inevitable in order to survive a fast development area of commerce. Since the 19th century patternmaking has continued to develop into more organized formats and now there are basically four different pattern making systems available.

The four different patternmaking methods commonly used by fashion designers and patternmakers in the industry and educators in the education field are:

1. Draping
2. 2. Pattern drafting
3. 3. Flat patternmaking
4. Knock off

The draping method involves creating the pattern pieces by applying fabric directly onto the three dimensional dress form.

Pattern Drafting

Direct pattern drafting or pattern drafting is a system of patternmaking that uses a combination of ease allowance and body measurements taken from a dress form or fit model to create patterns including basic, foundation, and fashion patterns (Joseph-Armstrong, 2005).

The draping method involves creating the pattern pieces by applying fabric directly onto the three dimensional dress form. The advantage of using the draping method for patternmaking is that designers or patternmakers can transfer their two dimensional sketch to a three dimensional sample directly onto the dress form, which gives a reasonable view of the finished look of the design without having to cut and sew sample garments. The disadvantage of this method is that finding fabrics with an equivalent hand feeling/drape to a fashion fabric for a finished garment can be difficult and costly. Unfinished plain weaved cotton, or muslin, is normally used in the fashion industry and educational institutes for draping methods in order to lower cost, but often designers prefer to use fashion fabrics for better results. The expense in terms of material and time is why this 'ideal' method of developing design ideas is usually reserved for higher price fashion such as designer brands or 'Haute Couture'. It is common practice in the fashion industry to combine the draping method and the flat patternmaking method for faster production.

For example, Jaffe and Relis (2000) recommend using the draping method to develop the basic block, and then use the basic block for flat patternmaking.

Knock-Off

The aptly termed 'knock-off' is a frequently used method of creating patterns by copying ready-made garments. It is commonly used when a manufacturer wants to take advantage of a well publicised hot fashion item, sometimes from a famous designer label, without the need for lengthy preproduction time before the season ends or sales cool down (Joseph-Armstrong, 2005).

Underwear designers and patternmakers from the well-established bra manufacturing retailers and brands seldom knock off 'designer bras'. Instead, they are often encouraged to copy, recycle, or slightly alter existing patterns, or knock off their direct competitors' bras. This is because: 1) designer labels cater only for a specific target consumer group which is a very small part of the multi-million dollar bra industry, 2) the main purpose of the bra is for support not for fashion (although there have been changes in recent years), and most importantly 3) the copy/recycle/alteration/knock-off does not require professional training or experience in bra patternmaking. Therefore, this has been a quick and easy solution for the bra industry where well trained and experienced patternmakers are difficult to find. Whilst there are some innovative designers who create innovative products by adopting an out-of-box approach, the industry continues to predominantly use the "copy/recycle/alteration/knock-off" method(s). Consequently, this has stifled some creativity and innovation in bra patternmaking which requires a solid understanding of the relationship between body measurements and pattern.

The need for further development of the basic block led to the development of the concept of the intermediate block. The intermediate block, or foundation, is developed from the basic block to enable easier and faster pattern manipulation. Use of the intermediate block maximizes the utilization of flat patternmaking because it enables patternmakers to produce patterns for a variety of styles within a short period of time.

Whilst bras containing no wire, such as sports bras, can be developed from a basic bodice, using a basic bodice for underwired bra drafting remains a highly technical task.

Garment fit depends on five elements: (1) Grain (2) Set (3) Line (4) Balance and (5) Ease (Brown and Rice, 2000). These five elements are normally used as the evaluation tool for outerwear fit where the laws of gravity impact upon the whole garment. As the bra is resisting gravity which pulls the breast downwards it creates an undesirable shape as well as potential muscle and posture problems, particularly as the breast size increases. Since the bra is a foundation garment, it is required to support the weight of the breast. Therefore, bra making means not only producing an aesthetically pleasing appearance, but also making a functionally supportive garment. The bra doesn't have 'ease' to assist with evaluating proper fit. This is replaced by 'tension' because the bra wing is largely made up of stretch materials which require taking the 'ease' of a total of 10 cm-15 cm from the actual ribcage circumference. Consequently, in order to accomplish the goal of a good fit and an aesthetically pleasing bra, consideration needs to be given to the type and properties of the construction materials. As a result, a perfect fit is unlikely at the first attempt because various bra materials and the direction of cut make it difficult to achieve an immediate perfect fit even for very experienced patternmakers.

The Underwired Bra Patternmaking Process

The underwire itself can be categorized by three different centre heights; lower centre, medium, and full cup wire, and various wire gauges are available as well as a multitude of wire shapes. Typically, underwired bra pattern pieces consist of a bra cup, front centre, side panel, and wing. The front centre and side panels together are called a 'cradle'. Normally the front part of the bra is rigid and the back section (wing) is constructed of stretch material. When a wire is selected for bra design, there are three things which should be considered; curve, tension and the length of wire. Bra band patternmaking starts with the shape of wire, and bra cup patternmaking depends on the wire centre height along with the breast measurements.

"Ideal" Body Measurements for 75B and Direct Drafting of Full Cup Bra Body Measurements.

The basic bra sizing system currently used consists of two measurements; the circumference of the ribcage, and cup size. Normally, production samples are made for size 34B/75B. The metric system is used for pattern drafting since 75 cm is a more exact ribcage measurement whilst a formula should be used for the imperial sizing system (34B). The difference between the ribcage and full bust circumference determines cup size. To some extent, 34B seems too small to be a standard size for patternmaking when commercial sizes range from 28-AA to 56-FF, but 34B "ideal" is not an entirely arbitrary designation because it represents the bust line considered most pleasing to the 'artistic' eye of most dress/outerwear designers—although there is clearly room here for disagreement!

Difference Between Ribcage and Full Bust Size

| Difference between ribcage and full bust circumference | Cup size (US sizing system) |
|---|---|
| 10 cm | AA |
| 12.5 cm | A |
| 15 cm | B |
| 17.5 cm | C |
| 20 cm | D |
| 22.5 cm | E |
| 25 cm | F |

Ideal Breast Measurements for 34B/75B

| WHERE TO MEASURE | MEASUREMENTS |
|---|---|
| Breast inner curve length | 9 cm |
| Breast outer curve length | 10 cm |
| Breast depth | 8.5 cm |
| Distance between bust points | 18 cm |

Patternmaking for an underwired bra consists of two basic patternmaking procedures: These are band drafting (SEE FIG. 19) and cup drafting (SEE FIG. 18). The band pattern shape depends on a wire curve and the cup pattern shape depends on breast measurements (breast inner curve length, outer curve length and breast depth). The following method is for a full cup underwire bra (a 215 mm length full cup wire was used for the sample patternmaking illustrated here).

Band Drafting

Finding the Centre of Wire

First of all, it is essential to identify the centre of the wire, which works as a fulcrum. Each end of the underwire tip should point directly towards an appropriate body point. The inner wire end should be directed towards the centre of the pit at the base of the neck and the outer wire end should point directly to the point of the shoulder. After defining the centre of wire, draw a horizontal line and a vertical line on a piece of paper. Place a wire by matching the inside curve of the centre point of the wire with the X-axis at the same time matching the inside of the inner wire end point with the Y-axis. Marking the centre of the wire can be done simultaneously or after marking the guideline.

Marking the Guide Lines

The total circumference of the bra band for 75B (excluding hook and eye tape) is around 60 cm. For this paper, 29.5 cm was used for the half of bra band width. The cradle width is nearly half of the bra band width. 15 cm was used for this paper. The width of the gore indicates the closest distance between the breasts or cups. It is important to note that there can be differences in this measurement between ethnic groups as well as individuals. 1 cm is used for the purposes of this paper.

Tracing Wire and Opening the Wire

Place a wire by matching the centre of wire to the horizontal guide line and trace the whole wire. After tracing, open the half of wire on the armhole side and trace the open shape of wire. Opening amount (a) between the original tip and open tip is between 1 cm and 2 cm. The amount depends on the shape and tension of the wire used. The purpose of this procedure is to mimic the open and bent shape of the wire when the bra is worn on a three-dimensional human body. 1.7 cm was used for the purposes of this paper.

Allowance for Wire and Wire Play

An 8 mm allowance (b) for both movement ease and sewing (bar tacking) is added on both wire tips and 6 mm wire play (c) is added. Wire play is literally where wire resides.

Mid-Point of Cradle Height

The mid-point of the cradle height (d) depends on the underband elastic tape width. In order to prevent flipping or a 'folding' effect on the mid-point of the cradle when a bra is worn, wire casing and underband elastic tape should be overlapped and sewn together. Therefore, when a 1 cm width of elastic tape is used, the mid-point height of the cradle should be 1.3 cm and when a 1.2 cm width of elastic tape is used, the mid-point height of the cradle should be 1.5 cm.

Wing Drafting

The starting point for wing drafting is finding the amount of wing drop. As the opening amount (a) gets bigger, so the wing drop (e) gets bigger. Some patternmakers suggest using a set amount for both opening of the wire and dropping of the wing.

The back of the wing height (f) is same as the hook and eye tape width since it is attached to a hook and eye tape. A 3.2 cm hook and eye tape was used for this sample. Coincidentally, a 3.2 cm drop of the back wing was also used for this paper.

Finishing the Band Drafting

The other lines are style lines and can be changed according to the design sketches. This is of course a matter for the patternmakers own judgement.

Measuring Joining Seam/Preparation for Cup Drafting

After finishing the bra band drafting, the length of the seam line where the cup will be sewn together should be measured. Each half of the curve is labelled as (g) and (h) for explanatory purposes.

Cup Drafting (A) Lower Cup

Guide Lines

Draw a vertical line for the breast depth of 75B (8.5 cm) and divide into two different lengths (5.5 cm and 3 cm) with a horizontal line.

Upper Curve Lines of Lower Cup

In order to achieve the breast inner curve length (9 cm) and breast outer curve length (10 cm) draw straight lines of 8.8 cm and 9.8 cm from B.P to each side of the horizontal guide line. Complete the curve lines by following the guide measurements (10 mm for centre side curve and 7 mm for the armhole side curve). Measure the curve lines in order to make sure the finished line lengths are correct.

Lower Curve Lines of Lower Cup

Once the upper half of the lower cup is finished, drawing the lower half of the lower cup is relatively easy. Draw two straight guide lines by connecting the two end points of the upper line with the 3 cm point on the centre guide line of the cup. Draw curve lines by following the guide measurements (8 mm for centre side curve and 9 mm for the armhole side curve). Measure the length of lower curve lines ('a' and 'b' as shown in FIG. 19) and write their lengths alongside both curve lines for future reference.

Splitting the Lower Cup

The lower cup can then be split in half and 4 mm of fullness can be added on the centre of the line. When two layers are used for bra construction, the inner layer can have a split for fullness and the outer cup, normally cut with a stretch material, can be used as one piece.

(B) Upper Cup

Joining Seam Length

Drafting the upper cup starts by dropping the centre point by 5 mm. The bigger the amount is, the 'pointier' the bra cup projection is. Draw a smooth curve which is close to the straight line to each side. Each side length from the bust point (B.P.) should be the same as the lower cup length (9 cm and 10 cm) because they will be sewn together. The armhole side of the upper cup is lifted 4 mm from the guide line in order to make the smaller cup edge/neck line length.

Upper Cup Height

Each side of the upper cup height (c and d) is calculated by subtracting lower curve lengths from the cradle joining seam. The following is a simple formula for each side of upper cup height length.

$$c = g(\text{bra band}) - a(\text{bottom cup})$$

$$d = h(\text{bra band}) - b(\text{bottom cup})$$

Shoulder Strap

A 1 cm width of shoulder strap was used for this sample. Other measurements are considered as design lines. After completion of the pattern drafting process, matching and reshaping of the pattern pieces is required. The seam allowance and notches are added afterwards.

Sample Work Drawing with Measurements.

It might be helpful here to provide some explanation of the industry practice in relation to how designers create a work drawing/technical sketch in order to instruct patternmakers. Generally, the designer measures an existing bra which is similar to what she wants to create and fills out the measurements along with a flat sketch so patternmakers can make patterns which will project the same fit. This practice is called preparing a 'knock off' and is one of the most popular methods used by industry fashion designers for both outerwear and under wear."

According to Wikipedia brassiere measurement refers to determining what size of bra a woman wears and mass-producing bras that will fit most women. Bra sizes usually consist of a number, indicating a band size around the woman's torso, and one or more letters indicating the breast cup size.

To mass produce bras, manufacturers size their bras to a prototypical woman called a "fit model".

A fit model is used by an apparel company as the "ideal" body type for whom the bra is designed. The fit model is chosen on her body size and proportions with the goal of representing all of the people in the target market.

Once the fit has been perfected on these models, the patterns are graded and the bra is made. The traditional bra cup is not shaped to conform to variations in the human female breast. In prior art, the cup of the bra angles upwardly and outwardly from an underwire (or wireless) attachment point, leaving little allowance for differences in breast shape, spacing and body type.

Manufacturing a well-fitting bra is a challenge since the garment is supposed to be form fitting but women's breasts can vary in volume, width, height, composition, shape and position on the chest. Manufacturers make standard bra sizes that provide a "close" fit however even a woman with accurate measurements can have a difficult time finding a correctly fitted bra.

Manufacturers may size and design bras to different standards of an "ideal."

The fit model is the determining factor of the fit of the bra. Even if a woman has the exact same measurements as the fit model the bra may not fit as current industry measurements don't account for breast and body variations."

In Industry, bras are manufactured based on a standard diameter measurement based on breast volume and a standard projection measurement based on the relationship between the underbust measurement and the overbust measurement. Based on these two industry standard measurements, the choices the customer has in actual fit variation is limited.

According to Foundations Revealed:

In the industry a single "core size" block is "graded" (adjusted) to produce the other sizes in the range.

The bra block is based on the assumption of an aesthetic optimum shape, a wire that is principally semicircular, a uniform diameter increment between wire diameters and a uniform volume increment between wire diameters.

Underwires are designed to have some spring. Made out of heavy gauge wire, sheet metal or plastic, they splay or spread wider once a bra is put on and fastened. Then they return to their original shape when the bra is taken off. This springing or splay gives additional support to your breasts. If your breasts are wider than the splayed diameter of the underwire, over time the pressure and weight of your breasts can cause an underwire to break in half. Wire breakage can also occur if your band size is too small and thus over-splaying the underwires.

Breasts have a natural "crease line" (inframammary fold) where the underwire should fit comfortably against the ribcage. The diameter of the underwire is too small if the underarm end is poking breast tissue, or catches the arm as it moves forward. The diameter of the underwire is too large if the underarm end is poking into the armpit. The best underwire is one that encircles the breast, giving a more rounded and defined look. Women short in stature usually find that underwires poke them under their arms. An instant solution is to select demi cup bras—the wires are shorter and thus will not poke.

Cups give a hemi-spherical shape to breasts and underwires give shape to cups.

The breast volume is a very essential dimension related to bra design. Although the volume of a breast can be visualized using the 3D body scan data, it is very difficult to obtain accurate natural breast volumes because the borderline of the breast is not clear enough to be defined separately from the body surface. Medical research studies have investigated breast volume measurements for asymmetry assessment or breast surgery. In contrast, there is limited information relevant to the investigation of the 3D breast shape in the apparel industry. Moreover, many previous studies ignored the curved character of the 3D breast base. Most of the studies assume that the breast base is a circle and the breast bulk is a cone (Lee et al., 2004).

In Foundations Revealed "How to Make a Bra" it is taught to take a breast root trace with a flexicurve, you have to make sure the flexicurve (measuring device) is up against the point around where your breast tissue joins the chest wall. This is the same point around the breast where the underwire of a correctly fitting bra should sit, not on the breast tissue (pain) and not away from the breast (poor fit).

In "Wires 101"/The Lingerie Addict blog:

"An underwire is an artificial, idealized form of the breast root. The root of the breast is where the breast joins the body.

Underwires are narrower than our breasts, but once put into a bra the fabric sides of the bra pull them out. The sides and the cup form a cantilever which lifts the breasts upwards from the base—which is why you shouldn't need the straps of your bra for much support.

Most women have one breast larger than the other, but wires of course, are identical providing a more symmetrical base. The main function of the underwire is to push the breast into a certain shape. The breast is contained inside the wire outline and the breast volume pushed into the wire outline and the breast volume pushed into a chosen direction to give a certain appearance or fashion shape for the specific bra. Wires provide support in combination with the cradle and cup of the bra. Different wire types are intended to provide different shapes. There are three main types of underwire shapes but many subtle variations are found within each type. The main ones are day bra, plunge, and strapless."

It is instructed in the industry to fit underwires, the same underwires are used for the cups of sizes 36A, 34B, 32C, 30D etc. . . . so those cups have the same volume. The reference numbers of underwire sizes are based on a B cup bra, for example underwire size 32 is for 32B cup (and 34A, 30C . . . ). An underwire size 30 width has a curvature diameter of 3-inch ⅚≈9.7 cm and this diameter increases by ⅓ inch≈0.847 cm by size. The table below shows volume calculations for some cups that can be found in a ready-to-wear large size shop.

| Underwire size | Bra size (US system) | Bra size (UK system) | Cup diameter | Volume of one cup | Weight of both breasts |
|---|---|---|---|---|---|
| 30 | 32A 30B 28C | 32A 30B 28C | 9.7 cm (3 in ⅚) | 240 cc (0.51 US pt) | 0.43 kg (0.95 lb) |
| 32 | 34A 32B 30C 28D | 34A 32B 30C 28D | 10.6 cm (4 in ⅙) | 310 cc (0.66 US pt) | 0.56 kg (1.2 lb) |
| 34 | 36A 34B 32C 30D 28E | 36A 34B 32C 30D 28DD | 11.4 cm (4 in ½) | 390 cc (0.82 US pt) | 0.70 kg (1.5 lb) |
| 36 | 38A 36B 34C 32D 30E 28F | 38A 36B 34C 32D 30DD 28E | 12.3 cm (4 in ⅚) | 480 cc (1.0 US pt) | 0.86 kg (1.9 lb) |
| 38 | 40A 38B 36C 34D 32E 30F 28G | 40A 38B 36C 34D 32DD 30E 28F | 13.1 cm (5 in ⅙) | 590 cc (1.2 US pt) | 1.1 kg (2.4 lb) |
| 40 | 42A 40B 38C 36D 34E 32F 30G 28H | 42A 40B 38C 36D 34DD 32E 30F 28FF | 14.0 cm (5 in ½) | 710 cc (1.5 US pt) | 1.3 kg (2.9 lb) |
| 42 | 44A 42B 40C 38D 36E 34F 32G 30H 28I | 44A 42B 40C 38D 36DD 34E 32F 30FF 28G | 14.8 cm (5 in ⅚) | 850 cc (1.8 US pt) | 1.5 kg (3.3 lb) |
| 44 | 44B 42C 40D 38E 36F 34G 32H 30I 28J | 44B 42C 40D 38DD 36E 34F 32FF 30G 28GG | 15.7 cm (6 in ⅙) | 1,000 cc (2.1 US pt) | 1.8 kg (4.0 lb) |
| 46 | 44C 42D 40E 38F 36G 34H 32I 30J 28K | 44C 42D 40DD 38E 36F 34FF 32G 30GG 28H | 16.5 cm (6 in ½) | 1,180 cc (2.5 US pt) | 2.1 kg (4.6 lb) |
| 48 | 44D 42E 40F 38G 36H 34I 32J 30K 28L | 44D 42DD 40E 38F 36FF 34G 32GG 30H 28HH | 17.4 cm (6 in ⅚) | 1,370 cc (2.9 US pt) | 2.5 kg (5.5 lb) |
| 50 | 44E 42F 40G 38H 36I 34J 32K 30L 28M | 44DD 42E 40F 38FF 36G 34GG 32H 30HH 28J | 18.2 cm (7 in ⅙) | 1,580 cc (3.3 US pt) | 2.8 kg (6.2 lb) |
| 52 | 44F 42G 40H 38I 36J 34K 32L 30M 28N | 44E 42F 40FF 38G 36GG 34H 32HH 30J 28JJ | 19.0 cm (7 in ½) | 1,810 cc (3.8 US pt) | 3.3 kg (7.3 lb) |
| 54 | 44G 42H 40I 38J 36K 34L 32M 30N 28O | 44F 42FF 40G 38GG 36H 34HH 32J 30JJ 28K | 19.9 cm (7 in ⅚) | 2,060 cc (4.4 US pt) | 3.7 kg (8.2 lb) |
| 56 | 44H 42I 40J 38K 36L 34M 32N 30O 28P | 44FF 42G 40GG 38H 36HH 34J 32JJ 30K 28KK | 20.7 cm (8 in ⅙) | 2,340 cc (4.9 US pt) | 4.2 kg (9.3 lb) |
| 58 | 44I 42J 40K 38L 36M 34N 32O 30P | 44G 42GG 40H 38HH 36J 34JJ 32K 30KK | 21.6 cm (8 in ½) | 2,640 cc (5.6 US pt) | 4.8 kg (11 lb) |
| 60 | 44J 42K 40L 38M 36N 34O 32P | 44GG 42H 40HH 38J 36JJ 34K 32KK | 22.4 cm (8 in ⅚) | 3,000 cc (6.3 US pt) | 5.3 kg (12 lb) |

In Pattern School, it is taught the first step in determining your bra size, is your band size.

Cup size is estimated by subtracting the under bust (band) measurement from the bust measurement and comparing the result to the table below. Each cup has a fit range of 2.5 cm. Again this table is suited to Australian bras only. International countries use different values to achieve the same task. Be careful when ordering 'equivalent' bras from overseas because if they use inches then the larger sizes are not actually equivalent thanks to 1" being 2.54 cm and not 2.5 cm!

| Bust – Underbust | Cup Size |
|---|---|
| 6.5 – 8 cm | AA cup |
| 8 – 10.5 cm | A cup |
| 10.5 – 13 cm | B cup |
| 13 – 15.5 cm | C cup |
| 15.5 – 18 cm | D cup |
| 18 – 20.5 cm | DD cup |
| 20.5 – 23 cm | E cup |

Most wire manufacturers do follow the 1" increment system meaning you will have one wire that suits several different cup sizes. For example, an 8D uses the same wire as a 10C or a 12B or 14A.

There is a great amount of debate in which purists say manufacturers should create bras to fit dozens of different shaped breasts and not just volumes. As it is there are several cups for each band size, and if we went to several shapes for each of those cup volumes for each band, the sheer logistics would spiral into an economic and practical impossibility.

The breast can change shape reasonably well for its volume and the amount of discomfort usually increases with the degree its distorted.

The "aesthetic optimum" consists of a lower quarter spheroid and a slightly elongate upper quarter spheroid. If your breast doesn't fit this shape, it means you end up looking for a bra cup to suit your breast volume which will have a wire that doesn't properly fit the natural curve of your breast. While there is some variation among manufacturers you will always be limited by the commercially viable standard sizes.

In Foundations Revealed, Mark Garbarcyk discusses the problem with bra grading in industry.

When we want to change the size of a bra pattern/block we could draft a new block for the new size, but in the industry a single "core size" block is "graded" (adjusted) to produce the other sizes in the range.

Take, as an example, the British bra size system. There are 16 cup sizes, AA-A-B-C-D-DD-E-F-FF-G-GG-H-HH-J-K-L, and 6 band sizes from 30"-40". That makes 96 size options. Multiply that by 2 colourways (ie making white and black bras), and you and your company potentially have 192 different bras to make!

BUT what if you could use parts of one size bra in a different size bra? You can! Welcome to the world of bra CROSS GRADING.

If you take the cups and the cradle/underwires of a 34B bra and shorten the wings by the right amount, you have a 32C bra! Likewise, if you lengthen the wings on the cups and the cradle/underwires of a 34B bra by the right amount you will have a 36A bra! The same goes for other Cup/cradle sizes: the cups/cradle of a 38D bra are the same size cups/cradle as a 40C bra, and 36DD bra and a 34E bra, and so on and so on.

The table below shows cross grading using EN 13402 standard cup lettering.

| | | | | | | |
|---|---|---|---|---|---|---|
| Same cups and cradle | 30A | 32AA | 34AAA | | | |
| Same cups and cradle | 30B | 32A | 34AA | | | |
| Same cups and cradle | 30C | 32B | 34A | 36AA | | |
| Same cups and cradle | 30D | 32C | 34B | 36A | | |
| Same cups and cradle | 30E | 32D | 34C | 36B | 38A | |
| Same cups and cradle | 30F | 32E | 34D | 36C | 38B | 40A |
| Same cups and cradle | 30G | 32F | 34E | 36D | 38C | 40B |
| Same cups and cradle | 30H | 32G | 34F | 36E | 38D | 40C |
| Same cups and cradle | 30J | 32H | 34G | 36F | 38E | 40D |
| Same cups and cradle | 30K | 32J | 34H | 36G | 38F | 40E |

This cross grading system is also used for bra underwires: the underwires that are used in a 34B bra can also be used in a 36A bra, and so on.

The antiquated way in which women are measured for a bra is far from satisfactory, as it does not take into account the volume of the individual breasts and the variations in back size.

For UK sizing, measure in inches around the chest just under the breasts, then add 5" if the measurement is an odd number or add 4" if the measurement is an even number. This is your "Band size"—30, 32, 34, 36 and so on.

Now measure around the bust at its fullest part and take the band measurement (+5 or +4) away from this measurement. The difference—1", 2", 3", 4"—indicates your cup size.

Emma Scott states in "The Bra Fitting Bible": "For the purposes of breast analysis for cup size, bra cups are quite often reinforced with underwires. Underwires give added lift to breast tissue and keep the cup firmly against the ribcage Many women will complain that the underwires are uncomfortable and that they dig into the flesh.

Usually underwire discomfort is due to an incorrectly sized bra. An underwire will dig in when the bottom cup diameter, that is directly related to the cup volume, is too small. Choosing a larger cup size will solve this problem.

A good gauge of breast cup fit is to judge how the centre of the bra sits on the ribcage.

The portion of the bra that sits between the cups is referred to as the bra bridge (or gore). The bra bridge should sit flat against the sternum.

Bras are engineered to fit flat against the ribcage. If the bra bridge sits away from the chest wall, then either the band is too large, the cup is too small or a combination of both is wrong.

According to Wikipedia bras are one of the most complex pieces of apparel. There are lots of different styles, and each style has a dozen different sizes, and within that there are a lot of colors. Furthermore, there is a lot of product engineering. You've got hooks, you've got straps, there are usually two parts to every cup, and each requires a heavy amount of sewing. It is very component intensive. From 60-70% of bras sold in the United Kingdom and the United States use underwire in the cup. The underwire is made of metal, plastic, or resin. Underwire is built into the bra around the perimeter of the cup where it attaches to the band, increasing the rigidity of the bra. The underwire improves support, lift and separation. Wirefree or softcup bras support breasts using additional seaming and internal reinforcement. Some types of bras like T-shirt bras utilize molded cups that eliminate bra seams and hide the woman's nipples. Others use padding or shaping materials to enhance bust size or cleavage.

There is an increasingly wide range of brassiere styles available, designed to match different body types, situations, and outer wear. The degree of shaping and coverage of the breasts varies between styles, as do functionality, fashion, fit, fabric, and color. Common types include backless, balconette, convertible, shelf, full cup, demi-cup, minimizing, padded, plunge, posture, push-up, racerback, sheer, strapless, t-shirt, underwire, unlined, soft cup, and sports bra. Many designs combine one or more of these styles. Bras are built into some garments like camisoles, single-piece swimsuits, and tank tops, eliminating the need to wear a separate bra.

There is also a wide range of body shapes and breast variations. A womans breast tissue affects the way a bra fits. Full, semi-full, shallow and deflated are some upper breast shapes. Self-supporting, semi supported, settled and pendulous are some breast positions. Conical, thin, omega are some breast shapes. Touching, separated, splayed, narrow set and wide set are some breast positions.

According to Her Room, when selecting a bra, it is important to know that a cup size on one band size is not equal to the same cup size on another band size. When a manufacturer grades his patterns to create different sizes for a bra style, he moves the bust points slightly wider with each cup size increase. B cup bust points are ½" farther apart than A cups. Bust points get ¼" farther apart between B, C, and D cups, and ⅛" farther apart with larger cup sizes.

An element of the proper fitting bra is the center panel, or gore. It is best if the center panel between the cups sits firmly against your chest.

In order to put some order into a product that has so many variations, the industry devised a sizing system to organize and categorize bras for fit, and manufacturing purposes. The system is based off of measurements of an original fit model and the variations in sizes (cross grading and sister sizes) are based off of that body type. If your body is not a variation of that "ideal" it will be difficult to find a comfortable bra. Bras are designed to fit tight to form and the engineering dynamics only work properly when all of the components are in sync. One variation can throw the engineering off and compromise the comfort of the bra.

From Bra Making Pattern School

"We need to understand the purpose of a bra. Firstly, and most importantly, the bra functions as a support device to limit the motion of the breast during activity. Secondly, the bra serves to redistribute the forces of breast weight to the back and shoulder.

A bra is supposed to lift the breast and take the weight off the ligaments preventing sagging and stretch marks. So how do we carry the weight of the breast. Typically, this has been done by encasing the breast volume in some form of cup and then positioning the cup in a specific position on the chest using straps or close fitting bodices like corsets. The cup needs to encase enough of the breast volume to hold it in place during the anticipated activity.

Unlike other areas of the body, the breast has undercut shapes that requires close fitting in order to create the supporting shape.

In pattern making, unless you surround the entire breast the only way to maintain closeness of fit is with a stiffened former called and underwire. An underwire is a device typically made of steel that is inserted into the garment to force it to stay in a predetermined, though mostly semicircular shape. With semicircular wires available in incremental sizes, how do we decide the shape of a bra? Should the bra conform to the natural shape of the unsupported breast? Once we support the breast its clearly going to change shape based on how its supported.

The breast can not only change shape but have its center of gravity moved up or down and side to side relative to the chest. The pursuit of aesthetic values over function have pushed breasts into shapes and positions they were never intended to go.

From the study "In Braless and Sports Conditions" Zhou Jie, Yu Winnie, NG Sun-pui state:

"Commercially available sports bras are classified into two different types—compression and encapsulation. The compression bra is designed to restrict movement of the breasts by compressing and flattening them against the body. The encapsulation bra is similar in appearance to everyday bras. It contains moulded cups that individually separate and support the breasts.

SUMMARY

A method of bra engineering is described using a combination of cup contours and diameters. Each cup having an inner cup size and an inner contour accommodating a given breast volume, and a larger outer cup diameter in which the filling material fills in, and expands the space between the inner contour diameter size and the larger diameter perimeter In order to solve the disadvantages and shortcomings in the prior art, the engineering of the brassiere enables the breast, ribcage and bra to work in harmony. The invention incorporates tension and compression within the cup as well as outside the cups and around the body.

BRIEF DESCRIPTION OF DRAWINGS

The above and other objects, features and advantages of the present invention will be made apparent from the following description of the preferred embodiments, given as non-limiting examples, with reference to the accompanying drawings in which.

DETAILED DESCRIPTION

A brassiere includes a first wing and a second wing, a closure including a first closure portion on the first end of the first wing, and a second closure portion on the first end of the second wing; and a pair of cups, with a first cup connected to the second end of the first wing, and a second cup connected to the second end of the second wing. Each cup includes an inner contour having an inner diameter size and an outer contour having an outer diameter having an outer diameter size.

Figure 1:
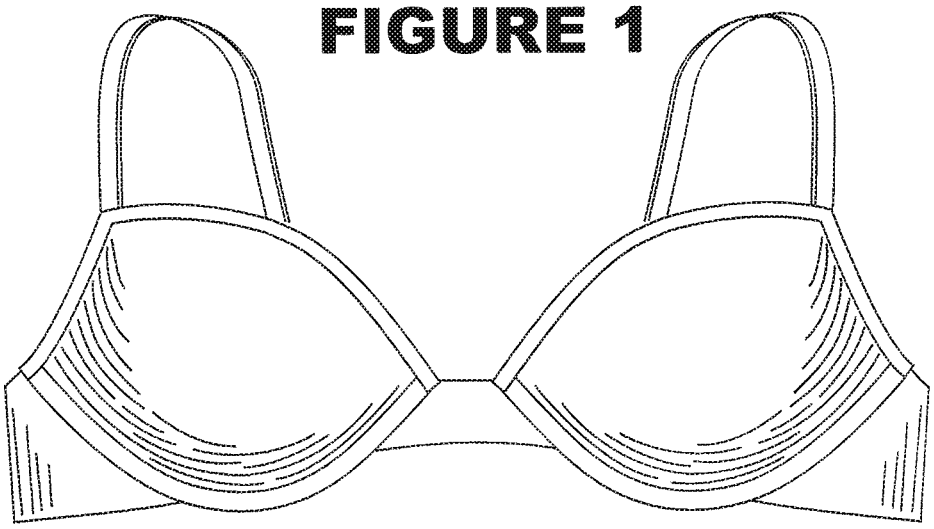
FIG. 1 is a front perspective view of a brassiere according to an embodiment of the present invention.
Figure 3:
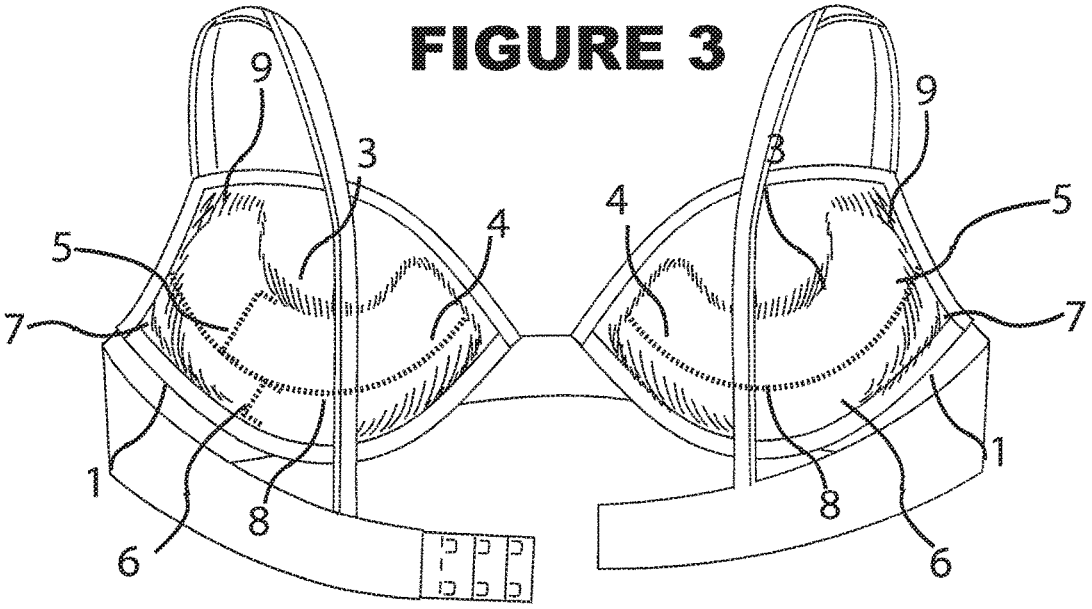
FIG. 3 is a rear perspective view of a brassiere according to an embodiment of the present invention, showing an inside view of the pad, cup and brassiere.
Figure 4:
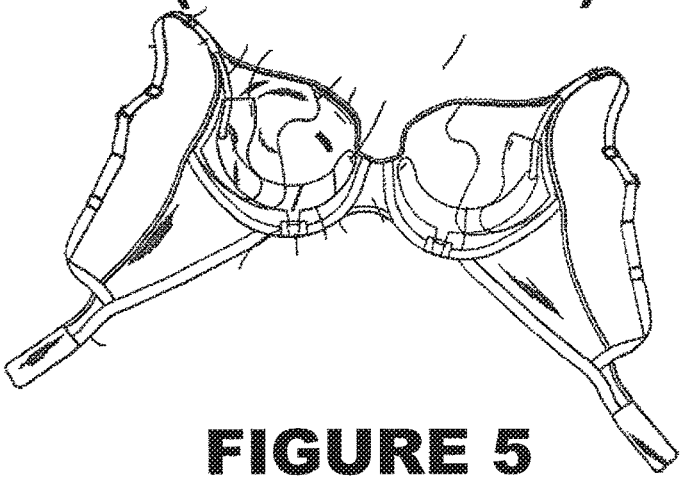
FIGURE 4 (PRIOR ART)
FIG. 4 is a front inside view of a prior art brassiere.
Figure 5:
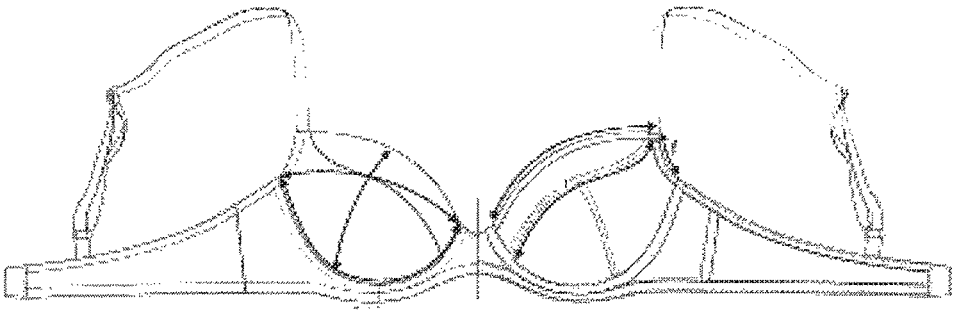
FIGURE 5 (PRIOR ART)
FIG. 5 is a front view of a prior art brassiere.
Figure 6:
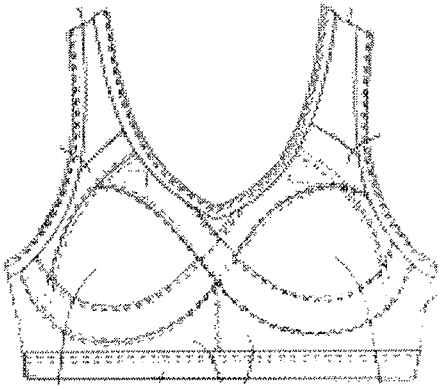
FIGURE 6 (PRIOR ART)
FIG. 6 is a front inside view of a prior art exercise brassiere.

As shown in FIG. 3, each cup includes an inner contour (5,6) shaped with an inner apical zone (3) matching a breast to receive a breast in a natural bust point position and an inner diameter contour (4), and and an outer contour FIG. 1 having a size larger than the inner contour diameter (1) and shaped with an outer apex (FIG. 1(11)) spaced medially, centered or laterally from the respective inner apex placement and filling material provided between the inner contour and the outer contour.

The brassiere of the invention contains the breast in wider cup, with the cup extending further than industry sizing, laterally, underneath and medially, outwardly and inwardly.

In the brassiere of the invention, the cups are spaced so that the gore touches the body and the edges of the cups extend to the outer edges of the breasts. The gore must touch the body for a brassiere to operate and function properly.

In the brassiere of the invention the cups (underwire or wireless) may be sized with bust point spacing, and the diameter of the arc of the wire (or cup base) is larger than in current bras.

In the brassiere of the invention, we have emphasized the width fullness, and not necessarily front projection fullness. We defined the lateral and medial projection, which has not before been discussed or recognized, nor does the prior art recognize it's importance.

Each cup has an inner contour shaped with an inner apical zone and a first diameter. The inner contour accommodates a first volume and a first size. An outer contour has a second volume larger than the inner contour and a diameter size larger than the inner contour and is shaped with an outer apex designed to the contour of the outer cup and diameter. Filling material is provided between the inner contour and the outer contour in a medial, lower and lateral portion of each of the cups to provide a natural fit and fill in medial breast portions, and lateral breast portions under the arm.

The engineering includes a combination of diameters geometries, and foam like contours. The cup is designed accommodating a first size "inner cup" contour, and a second size "outer cup" contour and diameter.

The breast and inframammary fold is supported by the contour inside the cup by fill (foam, etc.) between the "apical well" perimeter and the outer diameter. This is very different from industry method of bra design and engineering of setting the cup perimeter tight to the inframammary fold. The bra of this invention is supported on the rib cage by contours of fill (foam) inside the cup, coupled with the pulling force of the body circling components. The inframammary fold is supported inside the cup using new cup geometries formed by a larger diameter and shallower projection than industry standard. The location of the cups on the torso and the use of fill (foam) contours inside the cups has given the bra new engineering, biomechanics and breast adaptability. In the present invention, biomechanical performance is an important factor considered in our engineering.

Two measurements describe industry standard cup sizes. One is diameter size and the other is projection. In the present application when cup size is described we are using the inner "diameter size" as the size. When the "inner diameter" is referred to, it is a means to describe an "industry standard" cup size rather than describing an actual diameter size. It is descriptive of the cup volume or breast mound diameter. Since volume and breast mound diameter measurements are not recognized as "standard" measurements in the industry we use the "diameter size" measurement attached to a standard cup size to describe the approximate volume the cup is meant to contain. When referring to the outside diameter size, that is the actual measurement of a diameter attached to a standardized size.

The term "inner contour" or "inner diameter" describes a diameter about the area between the apical "well" and the outer diameter. The "inner diameter" is about halfway between the two. The term "outer contour" describes the outer convex cup or pad.

The outer diameter or cup base is the larger diameter measurement.

The term "foam" or "fill" is used to describe any "foam" or "elastic" like material forming our contours. It is to be understood the word foam is a representation of a resilient material that can be used to contour and is not limited to a specific material. The cups may be of the molded type. The cups and or contours may be inserts, they may be separate pillow like forms, they may be placed into a sling or pocket.

The term "around the body" or "body circling" is used to describe the wings, band or "side sections" of the bra, that tensions the bra and keeps it on the body. It can refer to adhesive attachments that do not circle the body completely but are used to keep the bra on the body.

For body shaping it's all to do with "negative ease", which means the garment is slightly smaller than the wearers body so that the wearers body adapts to conform to the shape of the garment. With a bra, the cut or shape of the bra moulds the breast into a more fashionable shape and position.

In the present invention a combination of tension and compression is used within the cup to support and shift the weight of the breast combined with tension and compression on the outside of the cup to contain and support the tension caused by the inner interaction. The compression on the inside of the cup is caused by the interaction between the interior cup contour material (fill), the breast and torso. The shape of the cup, the shape, density and flexible nature of the fill (foam) contour is an important component in the design. Combining the inner diameter together with the larger outer diameter, along with supporting the breast tissue in a flexible (i.e., foam) contour changes the cup dynamics, and makes it more adaptable to body movement and breast movement. The contours are designed to stretch and contract with the movement of the torso and the shift of the breast.

The inner and outer cup of the invention is designed to work with that movement. Industry bras are designed to contain the breast projection and weight by balancing and stabilizing the breasts on top of the rib cage. Traditionally, industry bra design is like a cantilever or suspension bridge. The weight of the breast is contained in cups supported by a band around the body to counterforce the cups and straps to support and hold up the weight.

Engineering for bra design hasn't changed very much in the past 70 years.

In the bra of the present application, the weight of the breast volume is contained in a contour between two diameters. The inframammary fold is supported inside the cup as opposed to prior art that uses the inframammary fold as the cup boundary.

We use a larger diameter than industry standard for the outer cup and perimeter combined with a second smaller diameter or "contour" of a second size to support the volume. Breast fullness is provided in the widthwise direction laterally, underneath and medially.

Figure 2:
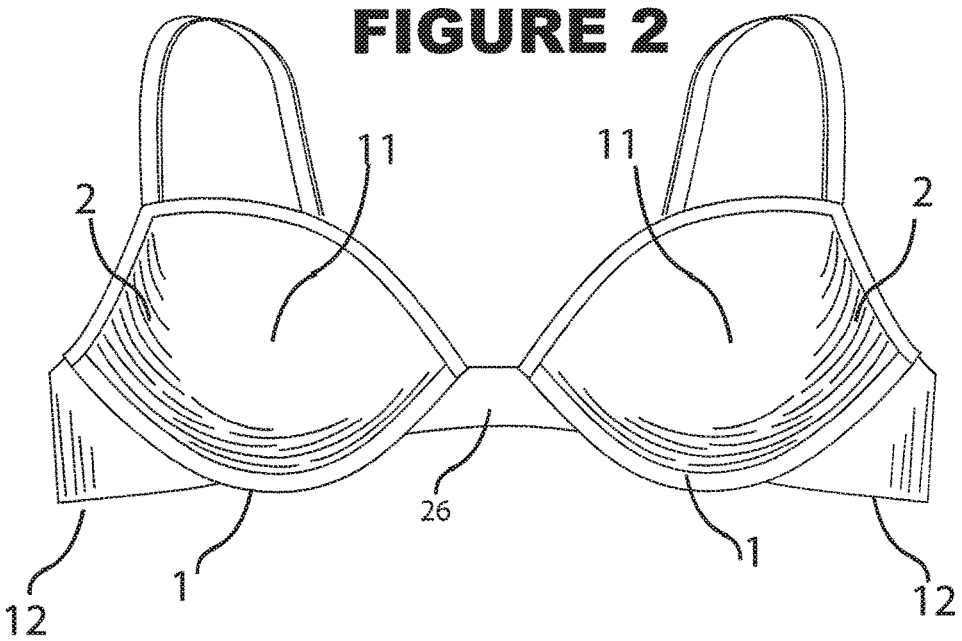
FIG. 2 is a front perspective view of a brassiere according to an embodiment of the present invention, showing an outside view of the brassiere.

The bra contains the breast with the cup extending further medially, underneath and laterally both outwardly surrounding the outer perimeter FIG. 2(2) and inwardly surrounding the breast volume and inner cup perimeter.

We extended the breast root and extended the boundary using fill inside, underneath and around the sides, using larger wider cups outside to create a comfortable and well-fitting bra. The cups expand and enhance the breast root while compensating for actual lesser tissue volume inside. The cups have a wider than standard diameter on the outside (i.e., C diameter on a B cup) and fill inside the cup to support the breast and hold up the larger outer cup and diameter. We created a sculpted weighted look medially, underneath and laterally outside, using the contour geometry of a larger diameter. We used about a (i.e., 34C 4⅝" diameter) on the outside of our cups to accommodate a smaller cup volume about (i.e., 34B 4½"diameter) inside, with an outside projection about somewhere between (i.e., 2½"-3") between an industry standard (34B) projection and industry standard (34C) projection. The inside breast projection would be equivalent to about a (34B 2" projection) measurement. "Double fill" cups use a diameter size two sizes larger than industry per projection. The "double fill" 34B uses a diameter size of about (34D 5⅛") and an outside projection somewhere between (3-4") between an industry standard (34C) projection and industry standard (34D) projection. The cups have an inside criteria and an outside criteria. The inside is sculpted to support the breast and fill in the areas that are missing in volume. The cup location on the torso is designed to shift the breast with the turn of the ribcage. The outside is sculpted to have a simulated look of a beautiful bust. We weighted the outside perimeter to extend the curve for the larger diameter and also to act as an opposing force to the inside fill around the perimeter. Each cup has an extended diameter of about ⅓" larger than industry standard diameters. The fill between the cup perimeter and the inner diameter (apical zone "well") FIG. 7(14,15) forms the support for the breast. The weight of the breast tissue is supported by the inner contour not the rim of the cup FIG. 2(1). The depth, height, density of the inner contour support (crown) FIG. 3(4) crests acting as a fulcrum between the torso, and the breast. This crest can be described as a crown somewhere between the apical zone FIG. 3(3) and the outer diameter (cup base) FIG. 2(1). Depending on the style of bra (i.e., plunge, bandeau, demi etc.), the foam (fill) contour may extend around the entire perimeter. In an embodiment of a strapless bra, the contour may start from the top of the cup on the lateral side, around the armhole, around the lower perimeter, rounding to the top of the cup perimeter on the medial side.

The contour between the perimeter of the inner apical "well" and the larger diameter has a minimum width of about ⅓" and a maximum width of about the perimeter of the apical "well". The size and shape varies depending on the size of the cup and the design of the bra. A bandeau is a fuller cup design as opposed to a demi which is much smaller. Exercise and swim bras may use fabrications with stretch and wicking fabrics that may effect the geometry of the contour, and technology and "smart bra" styles may incorporate sensor strips that would need to be incorporated into the cup. Larger breasts have more volume than smaller breasts and may require less fill and or different contour geometries. An important feature in the bra of the invention is the interaction of the downward force between the weight of the breast tissue acting on the contour, and the interaction between the inner contour and the outer diameter. The "crown" of the inner contour acts as a fulcrum. The design of the contour is determined by the shape of the cup (bandeau, day bra etc.), the volume and size of the breast, the function of the bra, and the modulus of the materials, The configuration of the inner contour is determined by the type, function and style of the bra. For example, a bandeau bra or strapless bra receives the breast in a generally balanced fashion. The inner contour fills the cup in an expanded U shape or an expanded inverted C. The plunge or pushup is designed to move the breasts toward the center of the body. The inner contour of the plunge may have a wider and higher contour (towards the top of the cup) on the lateral side than the medial side. It is well known in the industry that there are many different ways to fill a breast cup and direct the breast. Even though an expanded U shape or expanded inverted C is described, the contours forming the U and C can be divided into sections to create the same effect. The height of the contour and the density of the fill, is variable depending on the style and size of the bra. The geometries of the inside contours will always be different from industry size standards as the shape and dimensions of the pad/cup have different geometries than standard.

In general, an exercise bra is usually designed to constrain the breasts with compression or encapsulation or both, a yoga bra generally has less support, a running bra and crossfit more support. A "smart" bra may be designed for sensors to make contact with the skin surface.

The present invention may be designed with greater or lesser tension and compression depending on the bra's function.

The crest, or "crown" is designed to deform against the body when the bra is worn. This action pushes against the outer rim of the cup and expands the cup on the inside FIG. 14. If there is ample breast tissue in the cup, the contour will push the tissue up or in towards the center, depending on the inside contour and design of the bra. If there isn't excess tissue, the deformation will fill in areas of the cup that is empty.

Figure 9:
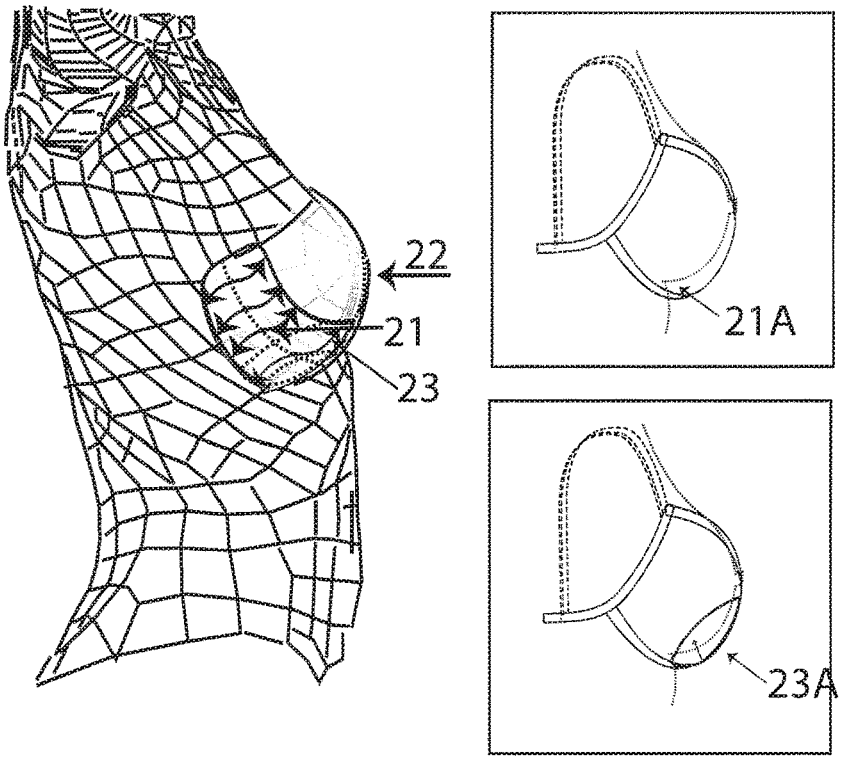
FIG. 9 is a side view of a cup according to an embodiment of FIG. 1 of the present invention showing an inside view of the cup on a body frame.

The outside of the cup (the front cup) was designed to look like a well-proportioned breast based on the outer diameter, FIG. 9(22,23) and the inside (such as the apical well, and the inner surface such as the protruding pad) was designed with fill (foam) to compensate for the differences in volume, shape, and size and to hold up and fill out the outer cups larger diameter. An outer apex FIG. 2(11), on the outer surface was designed based on the proportional geometry of the outer cup irrespective of the position of the bust point placement inside the cup. An inner apical "zone" or "well" FIG. 3(3) was created for the breast apex to be placed somewhere between the inner contour "crown" and the top of the cup.

Breast tissue extends laterally to the mid-axillary line and medially to the center of the chest. The mid-axillary line is considered the anatomic edge border of the breast. In the brassiere of the application, the cup extends the boundary of the breast (breast root), differing from the present industry, which uses the breast root trace, (the inframammary fold). Thus, the brassiere of the invention gives a fullness or the illusion of fullness because the cup extends the natural anatomic border of the breast laterally, underneath and medially allowing a new method of enhancement and bra engineering and design to be obtained.

The extended breast root diameter enhances and supports the root in a way that has not been discussed before, and supports the breast tissue with foam which makes for a more comfortable fit. The flexibility of the foam and the larger cup enables the sizing to have greater accommodation for variations in breast size, shape and spacing. The wider breast root base allows the cup to be designed from a wider trajectory.

Because there is more cup on the body and foam counterforcing the cups, the cups with the extended breast root diameter, the underwire (or wireless) cup is maintained on the chest wall more securely, and does not lie up onto or press against the outside of the wearers breast tissue. The inframammary fold is supported inside the perimeter of the cup by approximately ⅓ inch foam (the difference between standard diameter sizes). The foam may be concave on the inside and convex on the outside. In prior art the underwire or cup base is designed at the inframammary fold. The present embodiments make for a more comfortable fitting brassiere and enables the engineering and fit of the bra to work more efficiently.

The present brassiere contains the breast with the cup extending further laterally, outwardly and inwardly, instead of first projecting in the forward direction. The diameter of the breast can be enhanced at the root. In the present brassiere, the diameter of the arc of the cup wire (or wireless) is larger than in the current bras. A contour of greater fullness in the upper portion of the breast is created by the extension of the breast root and the extended enhancement of the lateral, lower and medial tissue.

The spacing between cups should be wide enough for the gore to contact the body, which is why we have developed a new system of measurement for an embodiment of the brassiere. We incorporated the spacing between the bust point location and the location of the cups on the band. By spreading out the cups and allowing the gore to sit flat against the chest wall the bra wings and cups are evenly distributed in tension and allow the bra to sit comfortably on the body.

Industry push-up bras push tissue from the sides and bottom and move the tissue to the cups. The brassiere of the invention positions the cups on the breasts and fills in the deficits. The brassiere includes pads that extend higher on the upper portion of the cup on the sides both medially and laterally, to fill in missing breast tissue and to hold up the larger cups. We surround the entire cup base perimeter with foam cresting somewhere between the cup perimeter and the apical "well" to enable the foam to counterforce the cup on the body and act as a fulcrum. We use the foam (fill) inside, around the cup to tension the cup against the body, along with the pull of the band. Dimensioning the cup with two cup size contours, surrounding the perimeter with "foam" on three sides, creating an apical well, is a new method of bra engineering.

This enables the cups (underwire, wireless etc.), gore, wings and straps (or strapless) to balance the forces of the bra and allow the design to work more effectively in tension and engineering. The inside bra cups are designed to contain tissue and fill (foam, etc.). The fill, fills in the tissue deficits in the cup, between the inner contour and the outer diameter, instead of relying on tissue that isn't there. We build the breast from out to in first, by using fill to fill in the larger diameter.

We prestress our cups using a combination of geometries, contours and foam. We created a force within the cups to expand the contour and shape the cup minimizing the need for maximum breast volume to fill out the cup. This is a great improvement over prior art.

Industry sizing is based on size aggregates, initial design of a fit model, and a tight fit to form bra.

If a person's size does not conform to the initial core size, it can be difficult to find a ready to wear bra that fits correctly.

Prior art designs the cups based on geometries of a semi-circle.

From a representative sample of bras, covering a wide range of styles, sizes and manufacturers, we sought to select a set of bra design features that differentiated Braverman's bras from the existing bras on the market. A total of 56 bras were used for the analysis: 15 from Braverman, and 41 from other prominent bra companies (see Table 1).

TABLE 1

| | A | B |
|---|---|---|
| 1 | Braverman Bras | Industry Bras |
| 2 | LB34A | Chang34A |
| 3 | LB34Ablk S | Chang34B |

TABLE 1-continued

| | A | B |
|---|---|---|
| 4 | LB34Abrnwl | Chang34C |
| 5 | LB34Anude | Chang34D |
| 6 | LB34APlunge | LaPerla 32D |
| 7 | LB34B | LaPerla 34A |
| 8 | LB34BPLUNGE | LaPerla 34A Nude |
| 9 | LB34C | LaPerla 34E |
| 10 | LB34CPLUNGE | LaPerla 36B |
| 11 | LB34DPLUNGE | LaPerla 36C |
| 12 | LB519plunge | LaPerla 38A |
| 13 | LB538fullcup | LaPerla 38C |
| 14 | LB538fullcupB | OG30B |
| 15 | LB538fullcupC | OG32A |
| 16 | LB538fullcupD | OG34A |
| 17 | | OG34A PL |
| 18 | | OG34B |
| 19 | | OG34C |
| 20 | | OG36A |
| 21 | | OG36B |
| 22 | | OG36C |
| 23 | | PRISMcabL |
| 24 | | PRISMcabM |
| 25 | | PrismL |
| 26 | | PrismM |
| 27 | | PrismS |
| 28 | | Stella 32A |
| 29 | | Stella 32B |
| 30 | | Stella 32C |
| 31 | | Stella 32D |
| 32 | | Stella 32DD |
| 33 | | Stella 32E |
| 34 | | Target 34A |
| 35 | | Vassarette34B |
| 36 | | W34A PL. |
| 37 | | WAL34A |
| 38 | | WAL34B geo |
| 39 | | WAL36A |
| 40 | | Wolf34A |
| 41 | | Wolf34B |
| 42 | | Wolf34C |

In Table 1, the following abbreviations for industry bras apply:

Samantha Change is abbreviated as "Chang".

Gossamer" is abbreviated as "OG".

Stella McCartney is abbreviated as "Stella".

Wolford is abbreviated as "W" and as "Wolf".

Walmart is abbreviated as "Wal".

Conceptualized within a machine learning framework, what we were looking for was a classification scheme—a way to objectively delineate between what currently exists and the innovation that Braverman proposed. While many algorithms exist to solve the classification problem in general, we elected to use a support vector machine (SVM) for the task, as it is a non-probabilistic, binary classifier, capable of both linear and non-linear classification. In an SVM model, each of the bras are considered as data points and are mapped in space according to the values of their features. The model then finds the boundary between the points that maximizes the distance between the two categories.

To solve the SVM algorithms for the charts, the Python programming language and scikit-learn were used. Python version 2.7.6 (Python Software Foundation), and scikit-learn version 0.14.1 on a Linux (ubuntu 14.04) machine were used for the analysis.

As an illustration, consider what emerges when one plots the bras in a two-dimensional space, where the x-axis represents the projection of the bra from the chest, and the y-axis represents the diameter of the bra (see Graph 1). Each point represents a different bra: the red dots are Braverman's, and the blue dots are the industry's. Notice how Braverman's bras occupy a categorically separate region of the space, representing a novel relationship between diameter and projection. This distinction is made precise by the SVM model, which finds the boundary between the bras that maximizes the separation.

What we've illustrated graphically is that, to date, the existing bras lie below the diagonal line, whereas Braverman's reside above the line. This is a concrete, pictorial manifestation of a difference between Braverman's bras and the rest of the industry's. And the meaning should be made explicit as well: what we have here is a truly novel and radical departure from the existing theory of bra design.

Numerically, the SVM establishes a boundary on the new territory that Braverman has carved out for herself. For any new bra, one can mechanically check whether it resides below or above the SVM boundary by simply plotting the bra according to its projection and diameter. And thus one can tell immediately whether it encroaches on this novel design feature. For example, a bra with a 2-inch projection and a 5.5-inch diameter would fall within Braverman's newly created space; but a bra with a 3-inch projection and 5.5-inch diameter would not.

Methodology

We assigned each of the 56 bras to one of three major categories: bandeau, plunge, or day bra (see Table 2). The different styles reflect important structural variations in bra design; it is most meaningful to compare bras of the same styles. Within each of these major categories, we allowed for 2 subcategories to further control for stylistic variations, thus providing us with greater power to elucidate meaningful, structural differences in bra design. See Table 2.

For each bra, we obtained measures of 26 different features and selected the ones that provided absolute differences between Braverman's and the others'. See Table 2.

TABLE 2

| Bra | Diameter | Underwire | Projection | A | OuterD | OuterUL | T | CHIN | CHOUT | BANDCGORE |
|---|---|---|---|---|---|---|---|---|---|---|
| **LB34A | 5.5 | 10 | 2 | 6.5 | 7 | 10.75 | 7 | 4.5 | 5 | 14 |
| Wolf34A | 5 | 9.375 | 2 | 6.5 | 6.5 | 9.75 | 6.5 | 5 | 5.5 | 14.5 |
| Wolf34B | 5.5 | 9.5 | 2.5 | 7 | 7 | 10 | 7 | 4.5 | 5.5 | 14.25 |
| Wolf34C | 5.5 | 10 | 3 | 8 | 7.5 | 10.25 | 8 | 4.75 | 5.25 | 14 |
| PrismS | 5 | 8.5 | 2.25 | 6.5 | 6.25 | 9 | 6.5 | 4.5 | 5 | 10.5 |
| PrismM | 5.5 | 9 | 2.25 | 7 | 6.75 | 9.5 | 7 | 4.5 | 5 | 13.5 |
| PrismL | 6 | 10 | 2.5 | 7.5 | 7.5 | 10.5 | 7.5 | 5.25 | 5.5 | 15 |
| Chang34A | 5 | 7.5 | 2.5 | 5.75 | 6.5 | 7.5 | 5.75 | 4.1 | 4 | 13 |
| Chang34B | 5.5 | 8 | 2.5 | 6.5 | 7 | 8.375 | 6.5 | 4.75 | 5 | 14 |
| Chang34G | 5.5 | 8.5 | 2.75 | 6.75 | 7.5 | 8.5 | 6.75 | 4.75 | 5.25 | 14 |
| Chang34D | 6 | 8.75 | 2.75 | 7 | 7.5 | 9.25 | 7 | 5 | 5.5 | 13.5 |
| OG34A | 5 | 7 | 2.25 | 6 | 6.5 | 7.5 | 6 | 4.25 | 4.75 | 13.5 |
| OG34B | 5.25 | 7.75 | 2.5 | 6.25 | 7 | 7.75 | 6.25 | 4.5 | 5.25 | 13.5 |
| OG34C | 5.5 | 8 | 2.75 | 6.5 | 8.5 | 7.5 | 6.5 | 5 | 5.5 | 13.5 |
| **LB34APlunge | 6 | 8 | 2.25 | 5.75 | 7 | 8.375 | 6 | 4.5 | 5.25 | 14.5 |
| OG36A | 5 | 7.5 | 2.25 | 6.25 | 6.75 | 7.75 | 6.25 | 4.75 | 5 | 14.5 |
| OG36B | 5.25 | 8.25 | 2.5 | 5.75 | 7 | 8.25 | 6.75 | 5 | 5.5 | 14.5 |
| OG36C | 5.5 | 8.5 | 2.75 | 7 | 7.5 | 9 | 7 | 5.5 | 6 | 14.75 |
| OG32A | 4.75 | 6.25 | 2 | 5.75 | 6 | 6.75 | 5.75 | 4 | 4.25 | 12 |
| OG30B | 4.75 | 6.5 | 2 | 5.75 | 6 | 7 | 5.75 | 4 | 4.5 | 11 |
| W34A PL | 4.5 | 7.75 | 2.5 | 5.5 | 6 | 8 | 5.5 | 4.5 | 5 | 14 |
| OG34A PL | 5 | 8.25 | 2.5 | 6 | 7 | 8.5 | 6 | 5 | 5.5 | 14.25 |
| WAL34A | 5 | 7.75 | 2.25 | 5.5 | 6.5 | 8.25 | 5.5 | 3.75 | 4.25 | 15 |
| Stella 32A | 4.5 | 7.25 | 2.25 | 5 | 6.25 | 7.5 | 5 | 3.5 | 4 | 13 |
| Stella 32B | 4.75 | 7.75 | 2.5 | 5.5 | 6.5 | 8 | 5.5 | 4 | 4.25 | 13.25 |
| Stella 32C | 5 | 8.5 | 2.75 | 6 | 7 | 8.75 | 6 | 4.25 | 4.5 | 13.25 |
| Stella 32D | 5.25 | 8.75 | 3 | 6.25 | 7.75 | 9.25 | 6.25 | 4.75 | 5.25 | 13.25 |
| Stella 32DD | 5.5 | 9.75 | 3.5 | 6.5 | 8.5 | 10 | 6.5 | 5 | 5.5 | 13.5 |
| Stella 32E | 6 | 10 | 3.75 | 7 | 9.25 | 10.25 | 7 | 5.5 | 6 | 13.25 |
| **LB34Anucde | 6 | 8.25 | 1.5 | 5.75 | 7 | 8.25 | 6 | 4.5 | 5 | 14 |
| Target 34A | 5.25 | 7 | 2.25 | 6 | 7 | 7.25 | 6.5 | 4.5 | 5.25 | 14.5 |
| Vassarette34B | 5.5 | 7 | 2.25 | 6.5 | 7 | 7 | 6.5 | 4.25 | 5.25 | 14 |
| LaPerla 34A | 4.5 | 6.25 | 2.25 | 5.75 | 6.5 | 6.5 | 5.75 | 4 | 4.25 | 13.5 |
| LaPerla 34A | 4.5 | 6 | 3 | 6.5 | 6 | 6.625 | 6.5 | 4.25 | 5 | 14.5 |
| LaPerla 32D | 6 | 8.5 | 3.25 | 7.5 | 8 | 9 | 7.5 | 5 | 5.75 | 13.5 |
| LaPerla 36B | 5.5 | 7.5 | 2.75 | 7 | 8 | 8 | 7 | 4.5 | 5.25 | 16 |
| LaPerla 36C | 6.25 | 8.5 | 3 | 8.5 | 7.75 | 9 | 8.5 | | | |
| LaPerla 38A | 5 | 7.75 | 3 | 7.5 | 7.75 | 8.25 | 7.5 | 5 | 5.5 | 15.5 |
| LaPerla 34E | 6.25 | 9.5 | 3.5 | 9 | 10 | 10 | 9 | 6.5 | 7.5 | 14.25 |
| LaPerla 38C | 5.75 | 11.5 | 3.5 | 8.5 | 10 | 12 | 8.5 | | | |
| PRISMcabM | 5.5 | 9.75 | 3 | 8 | 8.5 | 10.25 | 8 | 5 | 6.5 | 13 |
| PRISMcabL | 6 | 10.5 | 3.5 | 9 | 9.5 | 11 | 9 | 5.5 | 7 | 14 |
| **LB34Ablk S | 6 | 11 | 1.75 | 7 | 7 | 11.25 | 6.75 | 4.75 | 5 | 12.5 |
| **LB34Abrrrnl | 6.375 | 11.25 | 1.5 | 7 | 6.5 | 12 | 6.5 | 4.5 | 5 | 15 |
| WAL36A | 5.5 | 8 | 2.25 | 5.25 | 6.5 | 8.25 | 5.75 | 4 | 4.75 | 15 |
| WAL34B geo | 5.625 | 8 | 2.5 | 6 | 7.5 | 8 | 7 | 5 | 6.5 | 14 |
| **LB538fullcup | 6 | 8 | 1.75 | 6 | 7 | 8.5 | 5.5 | 4.25 | 5.25 | 14 |
| **LB519plunga | 6 | 7.75 | 1.75 | 5.75 | 7 | 8.5 | 6 | 4.5 | 5 | 14 |
| **LB34B | 5.75 | 10 | 2.25 | 7 | 7.25 | 10.75 | 7.5 | 5 | 5.75 | 14 |
| **LB34C | 6 | 10.5 | 2.75 | 7.5 | 8 | 11 | 8 | 5 | 5.5 | 14 |
| **LB34BPLUNGE | 6.25 | 8.75 | 2.5 | | 7.5 | 8.625 | | | | |
| **LB34CPLUNGE | 6.5 | 9 | 2.75 | | 9 | 8.875 | | | | |
| **LB34DPLUNGE | 6.5 | 9.5 | 3.25 | | | | | | | |
| **LB538fullcupB | 6.25 | 8.75 | 2.5 | | 7.5 | 8.625 | | | | |
| **LB538fullcupC | 6.5 | 9 | 2.75 | | 9 | 8.75 | | | | |
| **LB538fullcupD | 6.5 | 9.5 | 3.25 | | | | | | | |

| Bra | TIN | STRPBOTCGI | CUPTOCUPIN | PROJWIN | PROJLIN | STOPPHKUP | HKUPTOHKUP |
|---|---|---|---|---|---|---|---|
| **LB34A | 6.5 | 5 | 13 | 5.5 | 5 | 10 | 8 |
| Wolf34A | 6 | 5.25 | 11 | 6.25 | 4.75 | 9.5 | 9 |
| Wolf34B | 6.5 | 5.25 | 11.5 | 6.5 | 5 | 10 | 9 |
| Wolf34C | 8 | 6 | 11 | 7.5 | 5.125 | 9.75 | 8.5 |
| PrismS | 6.75 | | 11 | 6 | 5 | | 9 |
| PrismM | 7 | | 11.5 | 7 | 5.25 | | 10 |
| PrismL | 7.5 | | 12 | 7.75 | 5.5 | | 10 |
| Chang34A | 6 | 6 | 11 | 6.5 | 4.25 | 9.5 | 6.5 |
| Chang34B | 6.75 | 6.5 | 11.5 | 7 | 4.75 | 10.5 | 7 |
| Chang34G | 7 | 7 | 12 | 7.5 | 5.25 | 12.5 | 7.5 |
| Chang34D | 7 | 6.5 | 12.5 | 7.5 | 5.5 | 11 | 12 |
| OG34A | 5.75 | 5.75 | 10.5 | 5.5 | 4.75 | 9.75 | 6.25 |
| OG34B | 6 | 6 | 11 | 5.75 | 5 | 10 | 6.5 |
| OG34C | 6.25 | 6.25 | 12 | 6 | 5.25 | 10.5 | 7 |
| **LB34APlunge | 6 | 6 | 13 | 6.25 | 4.75 | 9.75 | 6.25 |
| OG36A | 6.5 | 6.25 | 11 | 5.75 | 5 | 10 | 7.5 |
| OG36B | 6.75 | 6.5 | 12 | 6.25 | 5.5 | 10.5 | 7.5 |
| OG36C | 7 | 7.25 | 13 | 7.5 | 6 | 11.25 | 7.5 |
| OG32A | 5.75 | 6 | 10 | 5 | 4.25 | 9.5 | 6.75 |

TABLE 2-continued

| | | | | | | | |
|---|---|---|---|---|---|---|---|
| OG30B | 6 | 6 | 10.5 | 5 | 4.5 | 9.25 | 6.375 |
| W34A PL | 6 | 7 | 11 | 6.75 | 4.75 | 10.5 | 7 |
| OG34A PL | 6.75 | 7 | 11.5 | 7 | 5.25 | 11 | 7.25 |
| WAL34A | 5.5 | 6.5 | 11 | 6 | 4 | 10 | 8 |
| Stella 32A | 5.25 | 5 | 10 | 5.5 | 3.75 | 8.5 | 6.75 |
| Stella 32B | 5.5 | 5.5 | 10.5 | 6 | 4 | 9.5 | 7.5 |
| Stella 32C | 6.25 | 5.75 | 11 | 6.75 | 4.5 | 9.75 | 7.75 |
| Stella 32D | 6.75 | 6 | 11.75 | 7.5 | 5 | 10 | 8 |
| Stella 32DD | 7 | 6.25 | 12 | 8 | 5.25 | 10.75 | 8.25 |
| Stella 32E | 7.25 | 6.75 | 13 | 8.75 | 5.75 | 12 | 8.75 |
| **LB34Anucde | 5.75 | 6 | 13.5 | 6.75 | 4.75 | 11 | 7 |
| Target 34A | 6 | 6 | 12 | 7 | 5.25 | 10 | 7 |
| Vassarette34B | 6.5 | 6.5 | 12 | 6.5 | 5.25 | 10 | 7 |
| LaPerla 34A | 5.75 | 5.25 | 10 | 5.5 | 4.375 | 8.5 | 6.25 |
| LaPerla 34A | 6.5 | 5.25 | 10 | 6 | 4.75 | 10 | 6 |
| LaPerla 32D | 8 | 7 | 13 | 7.5 | 5.5 | 11 | 7.25 |
| LaPerla 36B | 7.5 | 6.5 | 12 | 7.5 | 5 | 10.25 | 7.25 |
| LaPerla 36C | | | | | | | |
| LaPerla 38A | 7.75 | 6 | 11 | 6 | 5 | 10.25 | 6.5 |
| LaPerla 34E | 9 | 7.5 | 12 | 9 | 7 | 12 | 8.5 |
| LaPerla 38C | | | | | | | |
| PRISMcabM | 8.25 | 6 | 12.5 | 8 | 5.75 | 9.5 | 6.5 |
| PRISMcabL | 8.25 | 6 | 13.5 | 9 | 6.5 | 11 | 9 |
| **LB34Ablk S | 6.75 | 5.25 | 13 | 6.25 | 5 | 11 | 10.5 |
| **LB34Abrrrnl | 6.5 | 5 | 14 | 6.5 | 4.5 | 10 | 8.25 |
| WAL36A | 5.25 | 5.5 | 11.5 | 6 | 4.5 | 10 | 8 |
| WAL34B geo | 6 | 6.25 | 12.625 | 7 | 6 | 10 | 8 |
| **LB538fullcup | 5.5 | 6.75 | 13.5 | 6.75 | 5.25 | 11.25 | 9 |
| **LB519plunga | 5.75 | 6 | 13.5 | 6.25 | 4.5 | | |
| **LB34B | 7 | 5.5 | 13 | 6 | 5 | 10.375 | 9.25 |
| **LB34C | 7.5 | | 13.25 | | | | |
| **LB34BPLUNGE | | | | | | | |
| **LB34CPLUNGE | | | | | | | |
| **LB34DPLUNGE | | | | | | | |
| **LB538fullcupB | | | | | | | |
| **LB538fullcupC | | | | | | | |
| **LB538fullcupD | | | | | | | |

| Bra | LATARCCTR | CTOMEDARC | SAGCURVE | APEXOUTTOP | APEXOUTBOT | APEXINTOP |
|---|---|---|---|---|---|---|
| **LB34A | 5 | 5 | 3 | 2.25 | 2.75 | 2.25 |
| Wolf34A | 5 | 4 | 3.5 | 2.25 | 3.25 | 2.5 |
| Wolf34B | 5 | 4.5 | 3.5 | 2 | 3.5 | 2.25 |
| Wolf34C | 5.5 | 4.5 | 2.5 | 2 | 3.25 | 2.25 |
| PrismS | 4.5 | 4 | 2.5 | 2 | 3 | 1.75 |
| PrismM | 5 | 4.5 | 3 | 2 | 3.25 | 2 |
| PrismL | 5.25 | 5 | 3.25 | 2.25 | 3.5 | 2.25 |
| Chang34A | 3.25 | 4 | 2.25 | 1.5 | 3.5 | 1.25 |
| Chang34B | 3.5 | 4.5 | 3 | 1.5 | 3.5 | 1.5 |
| Chang34G | 3.5 | 4.75 | 3 | 1.75 | 3.5 | 1.75 |
| Chang34D | 3.75 | 4.75 | 2.75 | 2 | 5.5 | 2 |
| OG34A | 4 | 3 | 2.75 | 2 | 3 | 1.5 |
| OG34B | 4.5 | 3 | 2.75 | 1.5 | 3.5 | 2 |
| OG34C | 5 | 3 | 3 | 2 | 3.5 | 2.25 |
| **LB34APlunge | 4.5 | 3 | 3 | 2 | 3 | 2.5 |
| OG36A | 4.25 | 3.25 | 2.6 | 2 | 5 | 2 |
| OG36B | 4 | 4 | 2.6 | 2 | 5.75 | 2.5 |
| OG36C | 4.75 | 4 | 3 | 2.25 | 3.75 | 2.25 |
| OG32A | 3.5 | 3 | 2.25 | 1.5 | 2.75 | 1.5 |
| OG30B | 3.75 | 3 | 2.25 | 1.5 | 3 | 1.5 |
| W34A PL | 5 | 3 | 2.5 | 2 | 3.25 | 2 |
| OG34A PL | 5 | 3 | 2.5 | 2.25 | 3.25 | 2.25 |
| WAL34A | 4.25 | 3.25 | 2 | 1.75 | 2.25 | 1.75 |
| Stella 32A | 3.5 | 3 | 2 | 1.5 | 2.25 | 1.5 |
| Stella 32B | 4 | 3.5 | 2.25 | 1.5 | 2.75 | 1.5 |
| Stella 32C | 4.5 | 4 | 2.25 | 1.5 | 3 | 1.5 |
| Stella 32D | 4.5 | 4 | 2.5 | 2 | 3 | 2 |
| Stella 32DD | 5 | 4.5 | 3 | 2 | 3.5 | 2 |
| Stella 32E | 5 | 5 | 2.75 | 2.25 | 3.75 | 2.25 |
| **LB34Anucde | 5 | 4 | 3 | 2.25 | 3 | 2.25 |
| Target 34A | 4 | 3.25 | | 2.5 | 3.5 | 2.5 |
| Vassarette34B | 4 | 3 | | 2.5 | 3 | 2.5 |
| LaPerla 34A | 4 | 2.5 | 1.5 | 2 | 2.5 | 2 |
| LaPerla 34A | 4 | 2.25 | 2 | 2 | 3 | 2 |
| LaPerla 32D | 5.5 | 3.5 | 2.25 | 2.25 | 3 | 2.25 |
| LaPerla 36B | 5 | 3 | 2 | 2 | 3.5 | 2 |
| LaPerla 36C | | | | | | |
| LaPerla 38A | 5.5 | 2.25 | 2 | 2 | 3.75 | 2.25 |
| LaPerla 34E | 5.5 | 3.5 | 3 | 3.5 | 4 | 3.25 |
| LaPerla 38C | | | | | | |

TABLE 2-continued

| | | | | | | |
|---|---|---|---|---|---|---|
| PRISMcabM | 6 | 4 | 3 | 2.25 | 4 | 2.5 |
| PRISMcabL | 6 | 4.5 | 3.5 | 2.5 | 4.5 | 2.75 |
| **LB34Ablk S | 6 | 5 | 3.5 | 2.25 | 2.75 | 2.25 |
| **LB34Abrrrnl | 6 | 5.5 | 2.5 | 2.25 | 2.75 | 2.25 |
| WAL36A | 4.5 | 3.5 | 2.75 | 2 | 2.5 | 2 |
| WAL34B geo | 5 | 3 | | 3 | 4 | 3 |
| **LB538fullcup | 4.5 | 4 | 3 | 2.5 | 2.75 | 2.5 |
| **LB519plunga | 4.5 | 3.5 | | 2.25 | 2.75 | 2.25 |
| **LB34B | 5.25 | 5 | 2.5 | 2.25 | 3.25 | |
| **LB34C | | | | | | |
| **LB34BPLUNGE | | | | | | |
| **LB34CPLUNGE | | | | | | |
| **LB34DPLUNGE | | | | | | |
| **LB538fullcupB | | | | | | |
| **LB538fullcupC | | | | | | |
| **LB538fullcupD | | | | | | |

| Bra | APEXINBOT | STYLE | WIRETIPSPREAD | WIREDEPTH | RELAXDIAM |
|---|---|---|---|---|---|
| **LB34A | 2.75 | 1 | 5.25 | 3.25 | 6 |
| Wolf34A | 2.25 | 1 | 5 | 2.875 | 5.5 |
| Wolf34B | 3 | 1 | 5.25 | 3 | 6 |
| Wolf34C | 3 | 1 | 5.25 | 3.375 | 7 |
| PrismS | 2.75 | 1.5 | 4.76 | 2.75 | 6 |
| PrismM | 5 | 1.5 | 5 | 2.875 | 6.25 |
| PrismL | 3.5 | 1.5 | 5.375 | 3 | 6.5 |
| Chang34A | 3 | 1.5 | 4.75 | 2.125 | 5.5 |
| Chang34B | 3.25 | 1.5 | 5 | 2.375 | 6 |
| Chang34G | 3.5 | 1.5 | 5.25 | 2.625 | 6.25 |
| Chang34D | 5.5 | 1.5 | 5.5 | 2.75 | 6.5 |
| OG34A | 2.75 | 2 | 4.5 | 2 | 5.25 |
| OG34B | 3 | 2 | 4.75 | 2.25 | 5.5 |
| OG34C | 3.25 | 2 | 5 | 2.375 | 6 |
| **LB34APlunge | 2.25 | 2 | 5.5 | 2.25 | 6 |
| OG36A | 5 | 2 | 4.875 | 2.125 | 5.75 |
| OG36B | 3.25 | 2 | 5.25 | 2.25 | 5 |
| OG36C | 3.75 | 2 | 5.5 | 2.375 | 6.5 |
| OG32A | 2.75 | 2 | 4.375 | 1.875 | 5 |
| OG30B | 3 | 2 | 4.375 | 1.875 | 5 |
| W34A PL | 3.25 | 3 | 4.75 | 2.5 | 5.75 |
| OG34A PL | 2.75 | 3 | 5 | 2.5 | 6.25 |
| WAL34A | 2.25 | 3 | 4.75 | 2.25 | 5.75 |
| Stella 32A | 2.25 | 3.5 | 4.25 | 2.25 | 5.5 |
| Stella 32B | 2.75 | 3.5 | 4.625 | 2.25 | 6 |
| Stella 32C | 3 | 3.5 | 5 | 2.5 | 5.25 |
| Stella 32D | 3 | 3.5 | 5.25 | 2.75 | 6.5 |
| Stella 32DD | 3.5 | 3.5 | 5.5 | 2.875 | 7.25 |
| Stella 32E | 3.75 | 3.5 | 5.875 | 3.125 | 7.5 |
| **LB34Anucde | 2.5 | 3 | | | |
| Target 34A | 3.5 | 3 | | | |
| Vassarette34B | 2.5 | 3 | | | |
| LaPerla 34A | 2 | 2.5 | 4.25 | 1.75 | 5 |
| LaPerla 34A | 4.5 | 2.5 | | | |
| LaPerla 32D | 3.5 | 2.5 | 5.75 | 2.5 | 6.5 |
| LaPerla 36B | 2.75 | 2.5 | | | |
| LaPerla 36C | | 2.5 | | | |
| LaPerla 38A | 3 | 2.5 | | | |
| LaPerla 34E | 3.75 | 2.5 | | | |
| LaPerla 38C | | 2.5 | | | |
| PRISMcabM | 3 | 1 | | | |
| PRISMcabL | 3.5 | 1 | | | |
| **LB34Ablk S | 2.75 | 1 | | | |
| **LB34Abrrrnl | 2.75 | 1 | | | |
| WAL36A | 2.25 | 3 | 5.125 | 2.25 | 5.625 |
| WAL34B geo | 3.75 | 3 | | | |
| **LB538fullcup | 2.75 | 3 | | | |
| **LB519plunga | 2.5 | 2 | | | |
| **LB34B | | 1 | | | |
| **LB34C | | 1 | | | |
| **LB34BPLUNGE | | 2 | | | |
| **LB34CPLUNGE | | 2 | | | |
| **LB34DPLUNGE | | 2 | | | |
| **LB538fullcupB | | 3 | | | |
| **LB538fullcupC | | 3 | | | |
| **LB538fullcupD | | 3 | | | |

A key component in the analysis was the realization that projection played a pivotal role in differentiating Braverman's line of bras, and thus all two-dimensional plots incorporated the bra's projection. Effectively, the differences in bra design exist with respect to the bras' projection.

Figure 38:
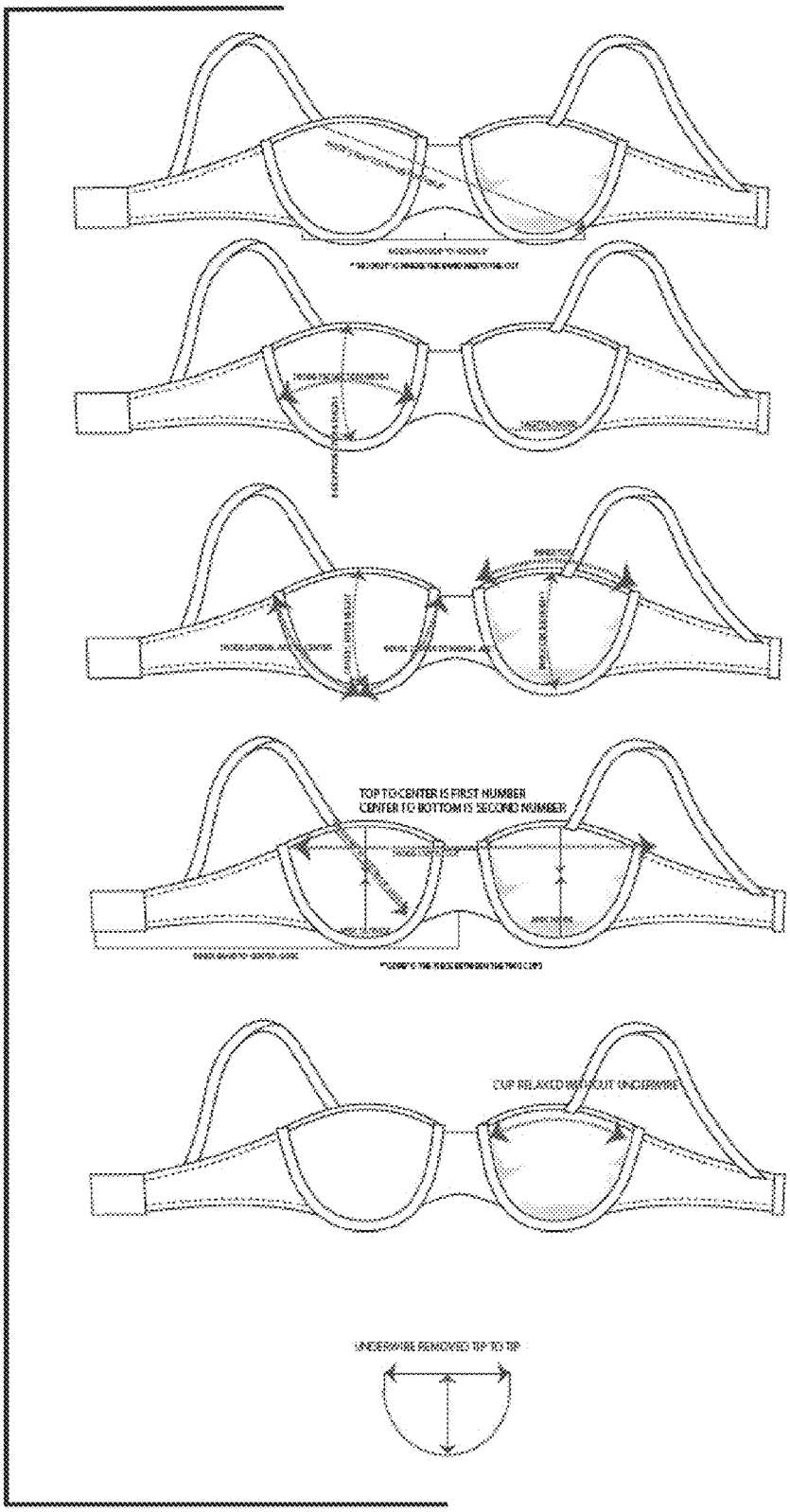
FIG. 38 is a chart showing geographical points.
Figure 39:
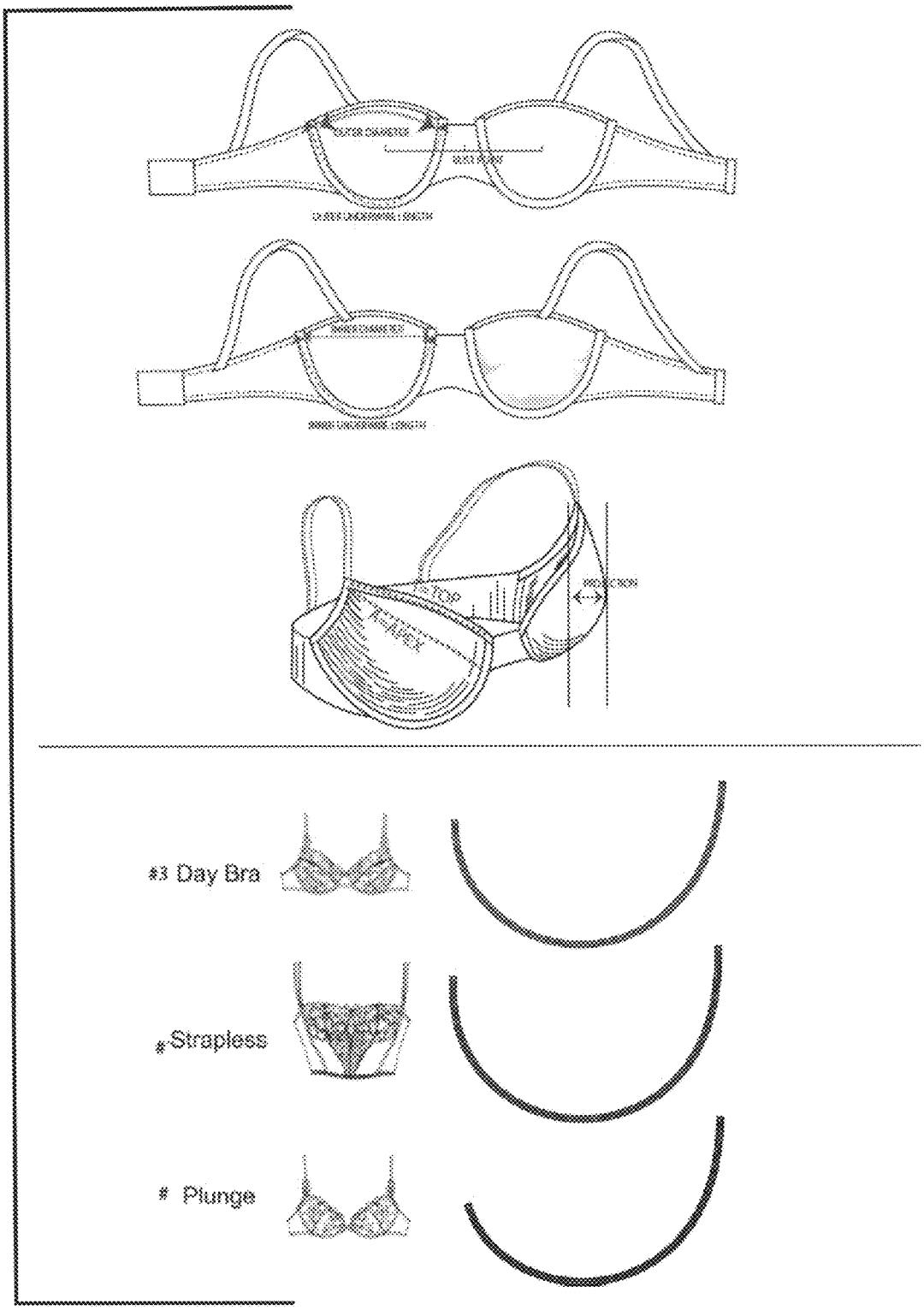
FIG. 39 is a chart showing geographical points.

The chart of FIGS. 38 and 39 discloses the geographical points measured on the present brassiere and the prior art brassieres:

After selecting meaningful features, all bras of a given style were plotted in two-dimensional planes, and the SVM model was computed to find the boundary between the bra designs. In most cases linear SVMs were sufficient, but polynomial kernels were used in instances where more accurate extrapolation was needed at the edges. See the graphs of FIGS. 21-37.

Results

1. Bandeau

The following 5 features of bra design showed categorical differences between Braverman's bras and the industry's, when considering all subtypes of the Bandeau (full cup) style with respect to each bra's projection:

i. i. CToMedArc (Graph 3)
ii. ii. CupToCupIn (Graph 4)
iii. iii. OuterUL—(Graph 5)
iv. iv. T—(Graph 6)
v. v. Underwire—(Graph 7)

When restricting attention to just those bras that are of the same subtype as Braverman's (i.e. Wolford, Prism Cab), the following feature also produced meaningful differences:

i. Diameter—(see Graph 8)

2. Plunge

For the plunge style, 3 features emerged as effective classifiers across all subtypes:

i. Diameter—(Graph 9)
ii. CupToCupIn—(Graph 10)
iii. ChOut—(Graph 11)

3. Day Bras

Finally, for the day bras, 4 features differentiated Braverman's bras from all the others, across all subtypes:

i. Diameter—(Graph 12)
ii. Underwire—(Graph 13)
iii. CToMedArc—(Graph 14)
iv. CupToCupIn—(Graph 15)

4. All Bras

With Wires.

For all bras with a wire, we were able to measure an additional feature that effectively distinguished between Braverman's and the industry's bras, namely the WireTipSpread—(Graph 16)

Similar Subtype.

Across all major styles, all bras in similar subcategories as Braverman's bras can be classified using the diameter to projection relationship (Graph 17).

Compete Set of Bras.

And in the most far-reaching result of our analysis, all bras measured for inner-cup-to-cup distance show a clear distinction between Braverman's and the rest of industry's (Graph 18).

For the above described graphs, the table below shows the bounds:

| | UPPER BOUND | LOWER BOUND |
|---|---|---|
| BANDEAU | | |
| CENTER TO MED ARC | 8" | 4" |
| PROJECTION | 5" | 1½" |
| CUP TO CUP IN | 17" | 11" |

-continued

| | UPPER BOUND | LOWER BOUND |
|---|---|---|
| OUTER UNDERWIRE LENGTH | 16" | 7½" |
| TOP | 13" | 5¼" |
| INNER UNDERWIRE LENGTH | 16" | 7¼" |
| INNER DIAMETER | 8" | 5" |
| PLUNGE | | |
| INNER DIAMETER | 9½" | 4½"" |
| PROJECTION | 5" | 1½" |
| CUP TO CUP | 17½" | 10½" |
| CENTER HEIGHT OUT | 11½" | 4¼" |
| DAY BRA | | |
| INNER DIAMETER | 8" | 5¼" |
| PROJECTION | 5" | 1½" |
| INNER UNDERWIRE LENGTH | 16" | 7" |
| CENTER TO MED ARC | 8" | 3" |

The curves that were used to separate the present bras from the prior art bras can also be defined using formulas. For each curve, there is an equation relating diameter to projection that describes the boundary between the present bras and prior art bras; for any Projection (x) value, the equation will return a Diameter (y) value, above which all of the present bras fall, and below which all of the prior art bras fall.

The equation for each curve is provided below.

$y=1.76x+0.79$ Graph 3:

$y=1.32x+9.25$ Graph 4:

$y=0.52x+9.39$ Graph 5:

$y=2.09x+2.55$ Graph 6:

$y=1.02x+7.58$ Graph 7:

$y=0.64x+4.06$ Graph 8:

$y=0.51x+4.80$ Graph 9:

$y=3.27x+4.81$ Graph 10:

$y=2.00x+0.62$ Graph 11:

$y=0.32x+5.14$ Graph 12:

$y=1.43x+4.80$ Graph 13:

$y=1.00x+1.75$ Graph 14:

$y=0.84x+11.28$ Graph 15:

$y=0.76x+3.61$ Graph 16:

$y=0.68x+4.08$ Graph 17:

$y=0.69x+11.24$ Graph 18:

For the AllAngleStrictLinear.png (top angle measure): $y=-16.69x+140.31$

For the BandeauAngleStrictLinear.png: $y=-14.45x+133.26$

For the DayAngleAllLinear.png: $y=-16.08x+139.93$

For the PlungeAngleAllLinear.png: $y=-15.82x+140.80$

In the present brassiere, using a larger diameter and shallower projection changes the shape of the pad. The inner contour is designed wider and higher than industry contours based on those differences FIG. 3(7,9).

Pendulous breasts fall down and to the side in their natural state. Industry takes them from the side, brings them to the center and lifts them up. The present brassiere extends the area of the breast root by using larger diameters for the cup than the standard diameter industry grade FIG. 8(20). Instead of attempting to move the breast apex to the bra in the center of the body, the brassiere of the invention contains the breast tissue in a foam like surround FIG. 8(17,18,19) and positions the breast in the cup at the root and redefines the lateral, lower and medial edge of the breast. Depending on the amount of fill inside the cup, the fill can lift the breast tissue and create a globulosity of the upper portion of the breast if that is desired. This globulosity can create cleavage in a different way than pushing breasts together from the sides. The fill can be used to make the breast tissue compact on three sides, FIG. 8(17,18,19) centers the mass and contains the volume of the breast using contours, tension and compression. The fill between the inframammary fold and the inner contour acts as compression between the torso and the cup perimeter FIG. 3(6). The inner contour using a larger diameter per size as a base FIG. 8(17) and the combination of an inner diameter FIG. 8(16) and outer diameter FIG. 8(17) is a new method of breast support. The cups are designed using tension and compression within the cups to conform to the movement of the body as it turns. By using larger diameters per inside volume the fill surrounding three sides FIG. 3(5,6) can be used to expand or contract the newly shaped cup perimeter. The outside of the cup was created to look like a well-proportioned breast based on the outer diameter, and the inside was designed to compensate for the differences in volume, shape and sizes.

Figure 13:
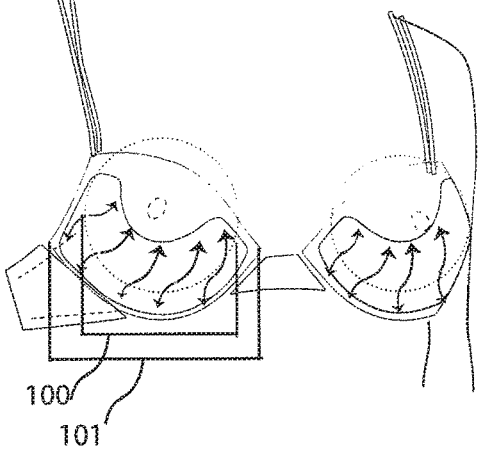
FIG. 13 is a front perspective view of a brassiere according to an embodiment of the present invention, showing an inside view of the brassiere supporting the breast from the inside.

Fullness in lateral, lower and medial positions provides that the bust is supported in a natural position FIG. 13. This is a much more comfortable position than trying to uncomfortably move tissue to an apex. Instead of taking breast tissue and trying to push it forward, we are maximizing its appearance first by filling out the breast laterally, underneath and medially. By spreading the breast tissue wider FIG. 13(101) (using three sides of the cup with foam and a larger diameter) we support and enhance the breast tissue in a different manner. This is more natural, and comfortable to the wearer. The contour FIG. 13(100) between the wider outer diameter and inner apical "well" counterforces the bra.

Figure 7:
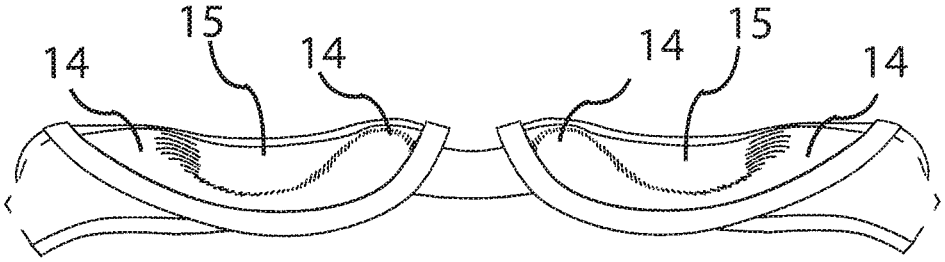
FIG. 7 is a top plan view of the embodiment of FIG. 1.

The foam on the wider inside pads FIG. 7(14) make the cups more adaptable to a variety of breast shapes while also increasing the accuracy of the fit with the foams cushioning characteristic.

This also makes the engineering of the bra fit better and more comfortably.

It makes the bra more adaptable to breast variations.

In the prior art, the tight fitting diameter of the underwire or wireless cups have too small of a diameter to contain the breasts comfortably against the ribcage and move comfortably with the breast tissue.

The tight fit also does not allow room for variation in the cups or for differences in breast shapes and tissue distribution.

By using a larger (than standard) size diameter on the outside and a smaller breast volume on the inside, and cushioned fill inside this invention gives the customer new and different choices in fit, comfort and sizes.

The brassiere of the invention contains the breast in a larger contoured cup. Our cup is a smaller cup size on the inside (i.e. C cup) and a larger size cup (and diameter) on the outside (i.e. D cup).

The brassiere of the invention also includes pads on the upper portion of the cup that extend higher FIG. 3(9) and wider FIG. 3(7) than in the prior art to fill in the deficits of the larger diameter outside cup and to counterforce the cup on the torso.

Figure 14:
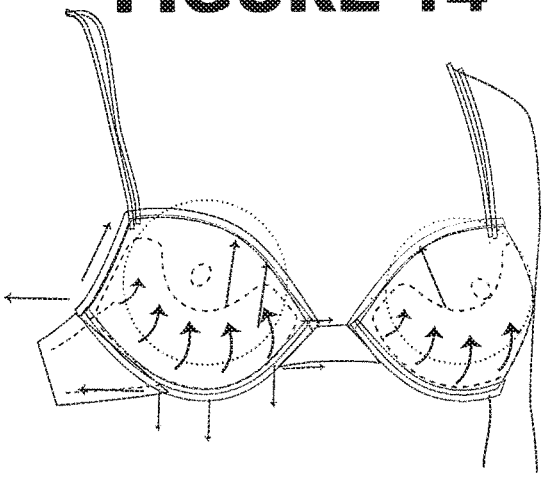
FIG. 14 is a front perspective view of a brassiere according to an embodiment of the present invention, showing an inside view of the brassiere.

The wider cups and gore spacing of our sizing enables the cups to be located on the rib cage so that the bra, cups and rib cage all work together with the turn of the body (FIG. 14). The wider cups and the location on the ribcage make the cups adaptable to the movement of the body. The gore spacing places the bra on the rib cage where it needs to be. The bra cup is engineered to work with and react to the ribcage. This is very different engineering than prior art. As the body turns, the interaction between the inner contour of the cup and the outer cup diameter moves the breast tissue within the cup and shifts the gelatinous tissue to conform to the cup position and body angle.

By changing the dimensions of the standard proportion for cup design, and using cushioned fill inside the cup as a counterforce there is more cup on the body than standard per size FIG. 13. The extended width in the cup allows the cup to conform to the ribcage and better adapt to the turn of the body FIG. 9(21). The location the cup sits on the body is important FIG. 10(24). The wider cup and fill combination and the different gore sizing allows the center gore FIG. 2(26) to sit flat against the sternum. The bra wings and cups are evenly distributed in tension allowing for a much more comfortable fit and enabling the bra to move comfortably with the body.

By extending the cup diameter a counterforce is created using fill (foam) within the cup.

Figure 12:
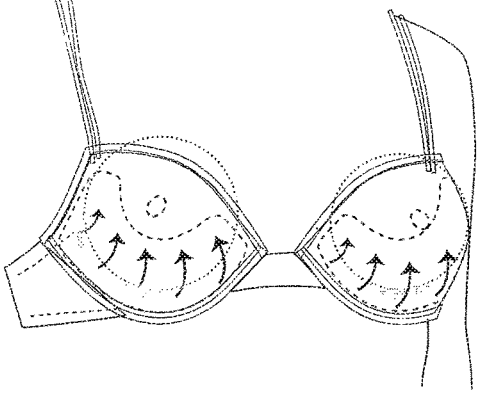
FIG. 12 is a front perspective view of a brassiere according to an embodiment of the present invention, showing an inside view of the brassiere supporting the breast from the outside.
Figure 15:
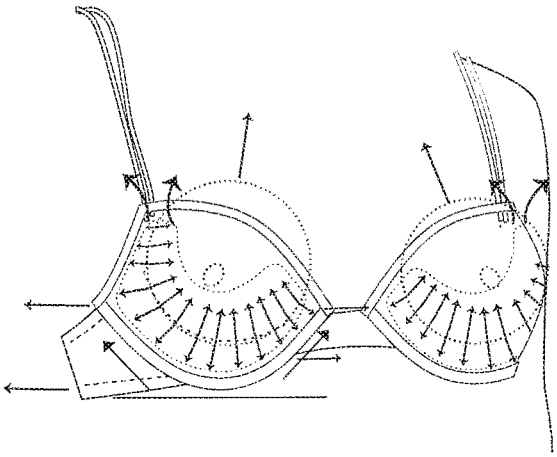
FIG. 15 is a front perspective view of a brassiere according to an embodiment of the present invention, showing an inside view of the brassiere supporting the inframammary fold.
Figure 16:
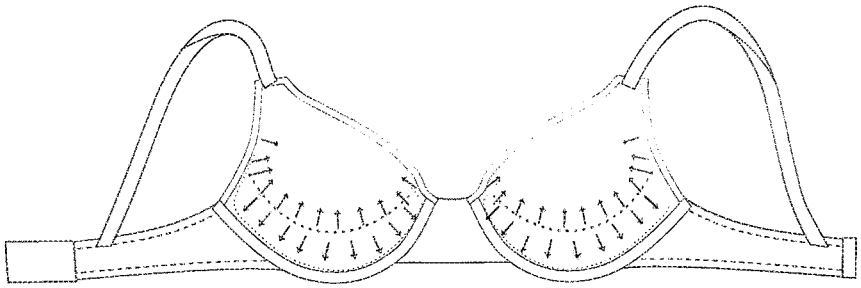
FIG. 16 is a front perspective view of a brassiere according to an embodiment of the present invention, showing an inside view of the brassiere.
Figure 17:
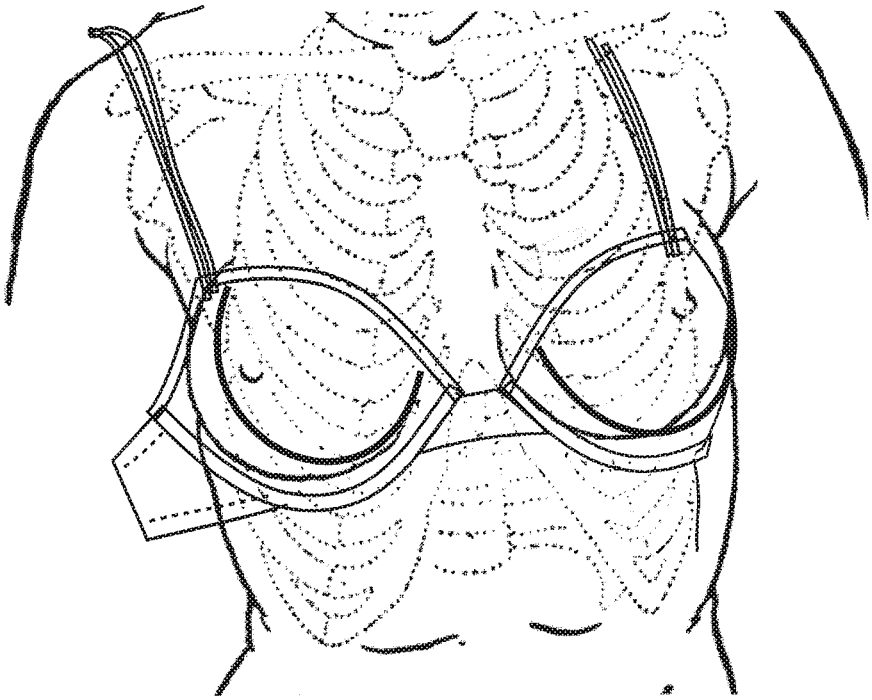
FIG. 17 is a front perspective view of a brassiere according to an embodiment of the present invention, showing an inside view of the brassiere located on a ribcage.
Figure 18:
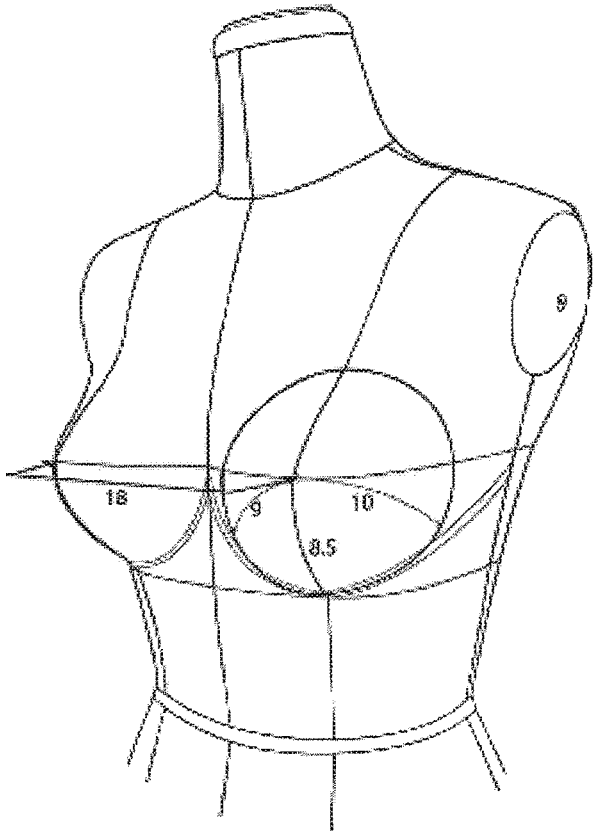
FIG. 18 is a view of cup drafting patternmaking.
Figure 19:
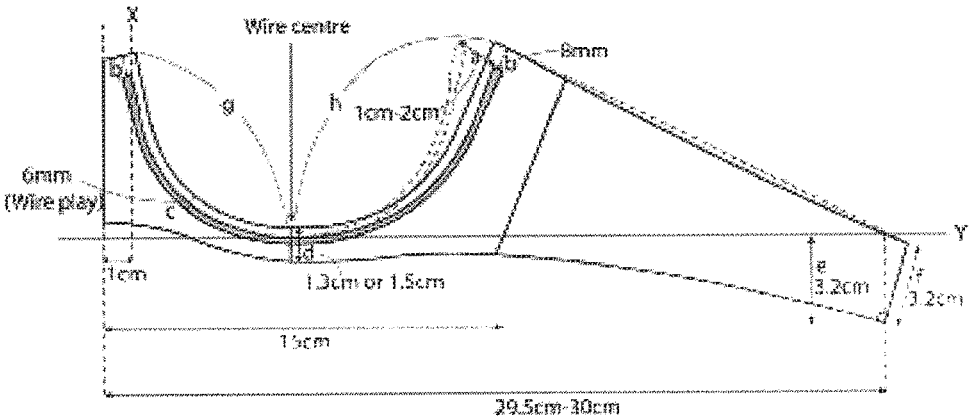
FIG. 19 is a view of band drafting patternmaking.
Figure 20:
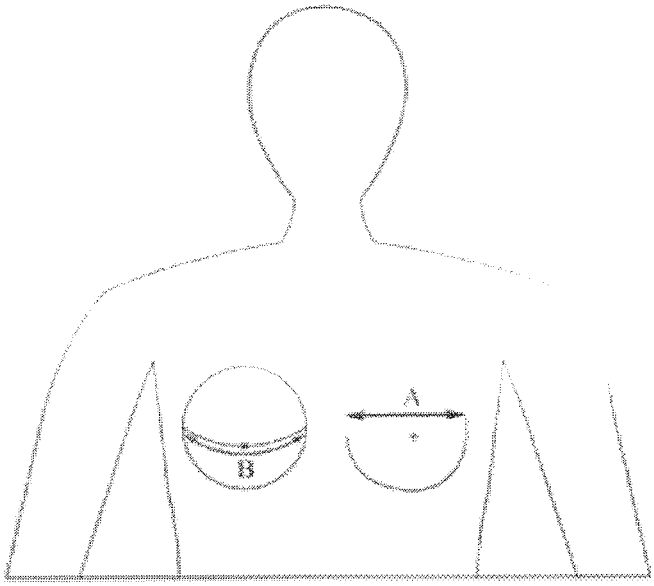
FIG. 20 is a view of breast mound spread and protrusion.
Figure 20:
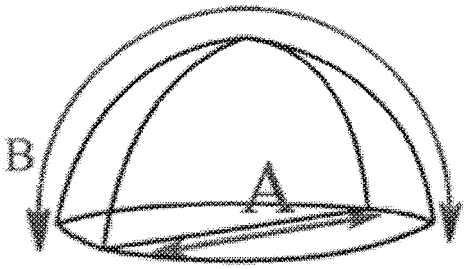
Figure 21:
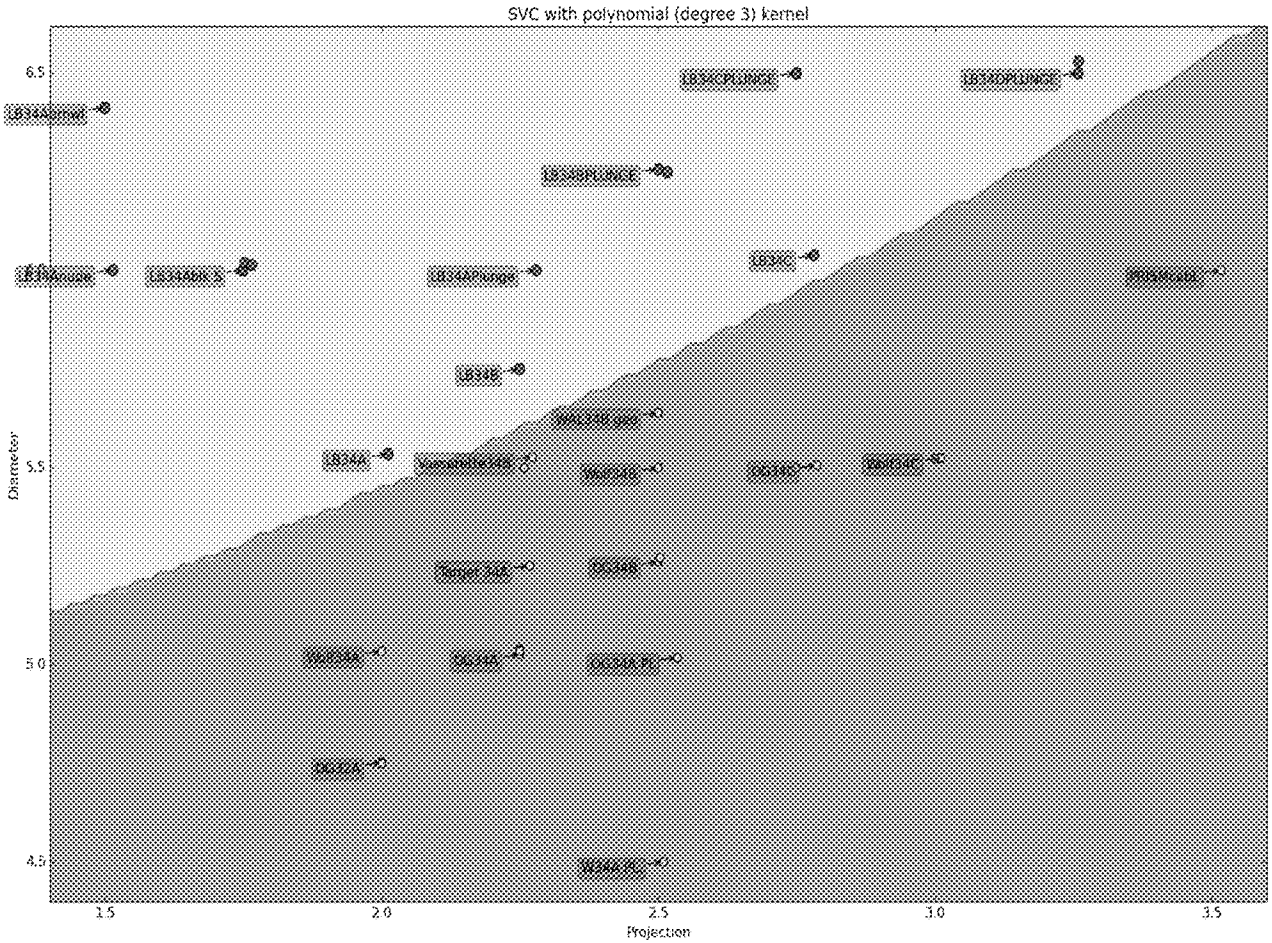
FIG. 21 is Graph 1.
Figure 22:
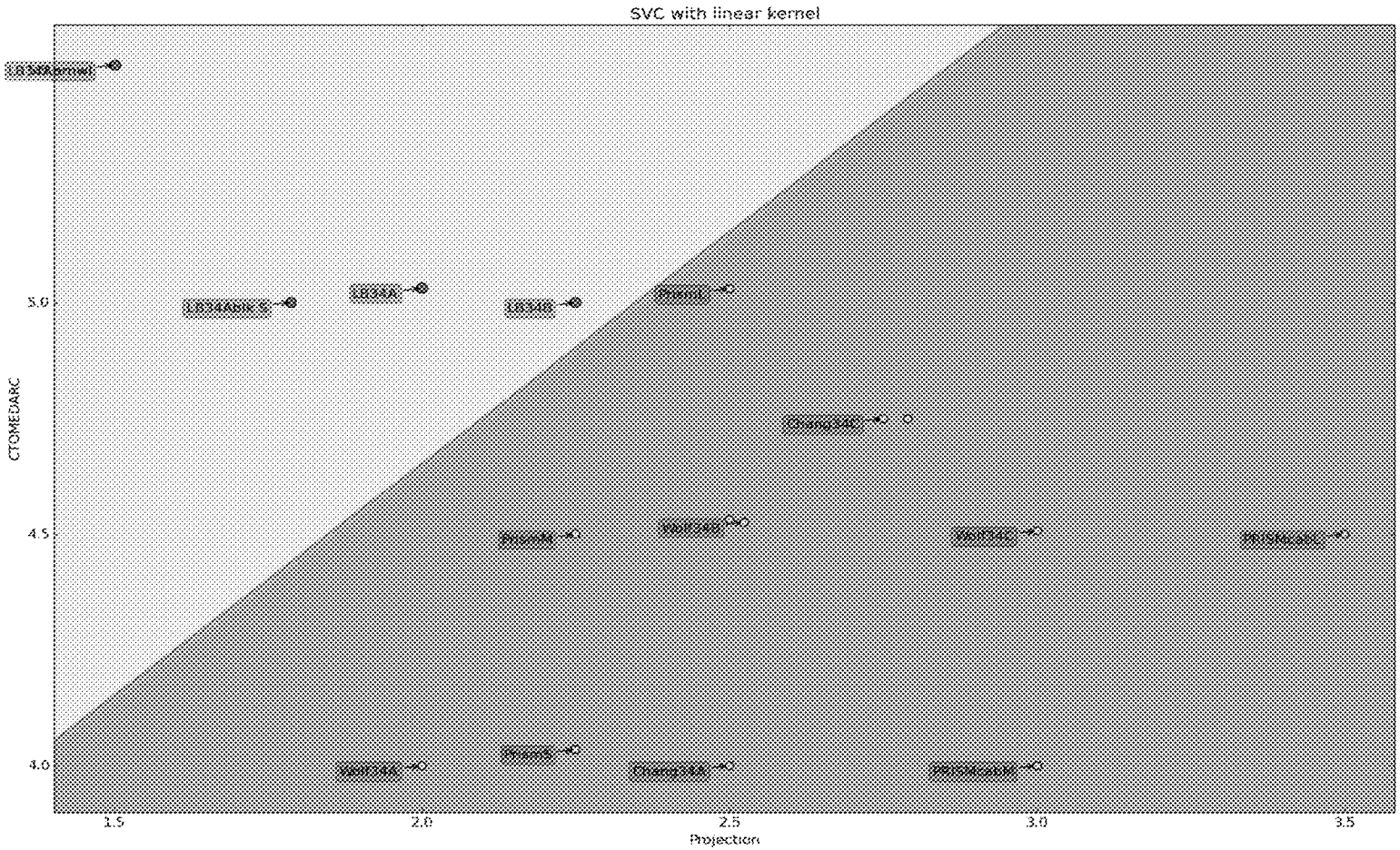
FIG. 22 is Graph 3.
Figure 23:
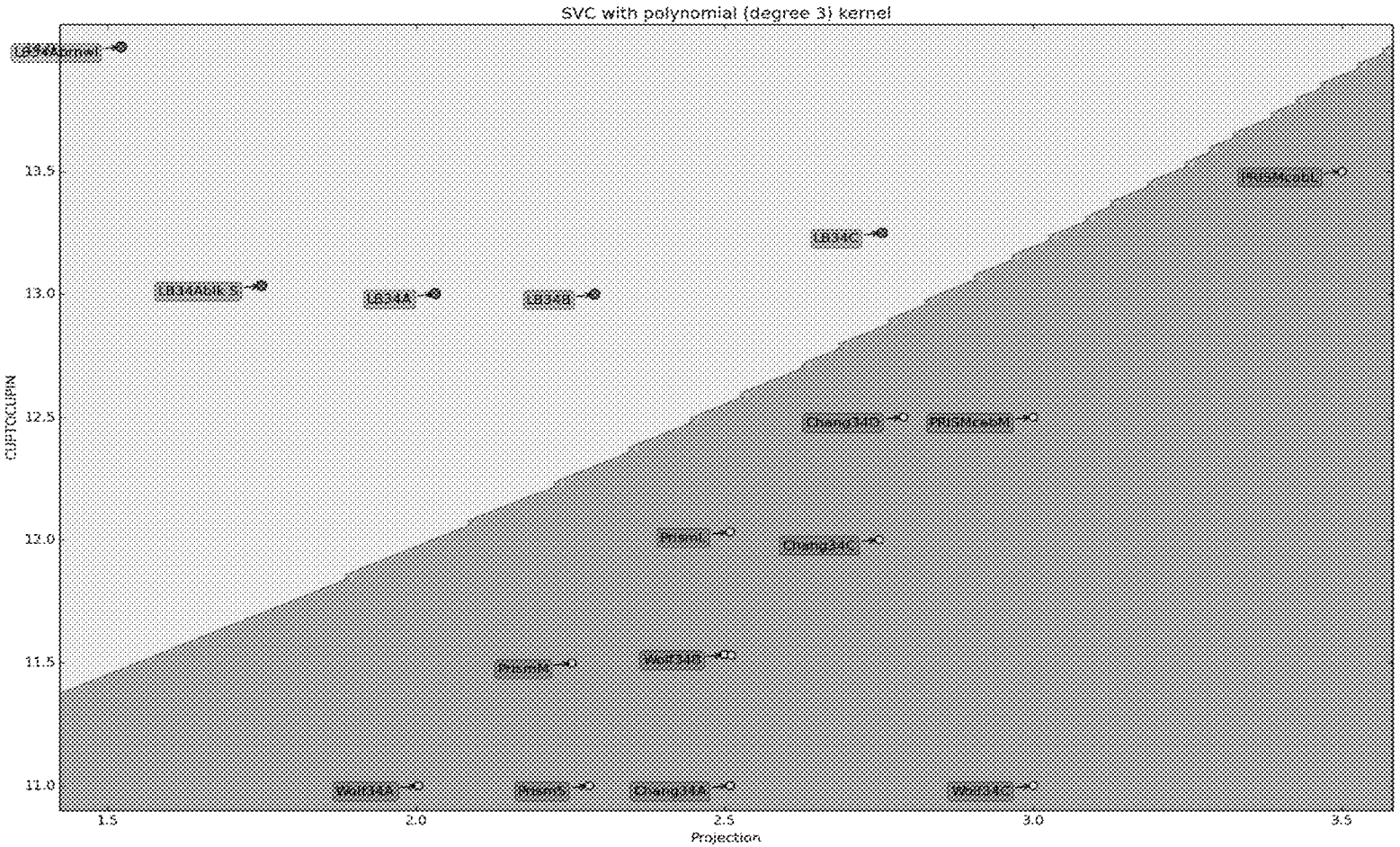
FIG. 23 is Graph 4.
Figure 24:
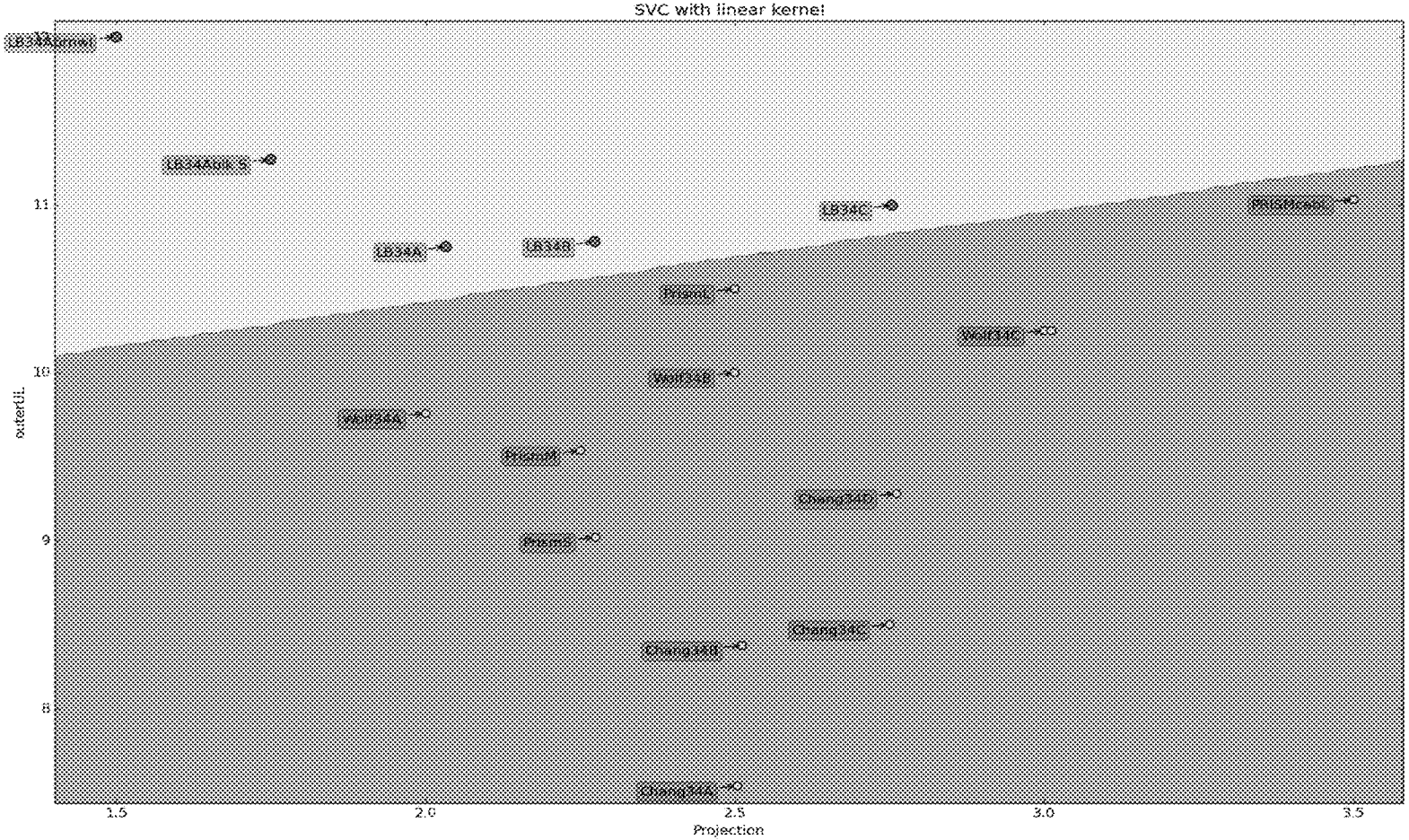
FIG. 24 is Graph 5.
Figure 25:
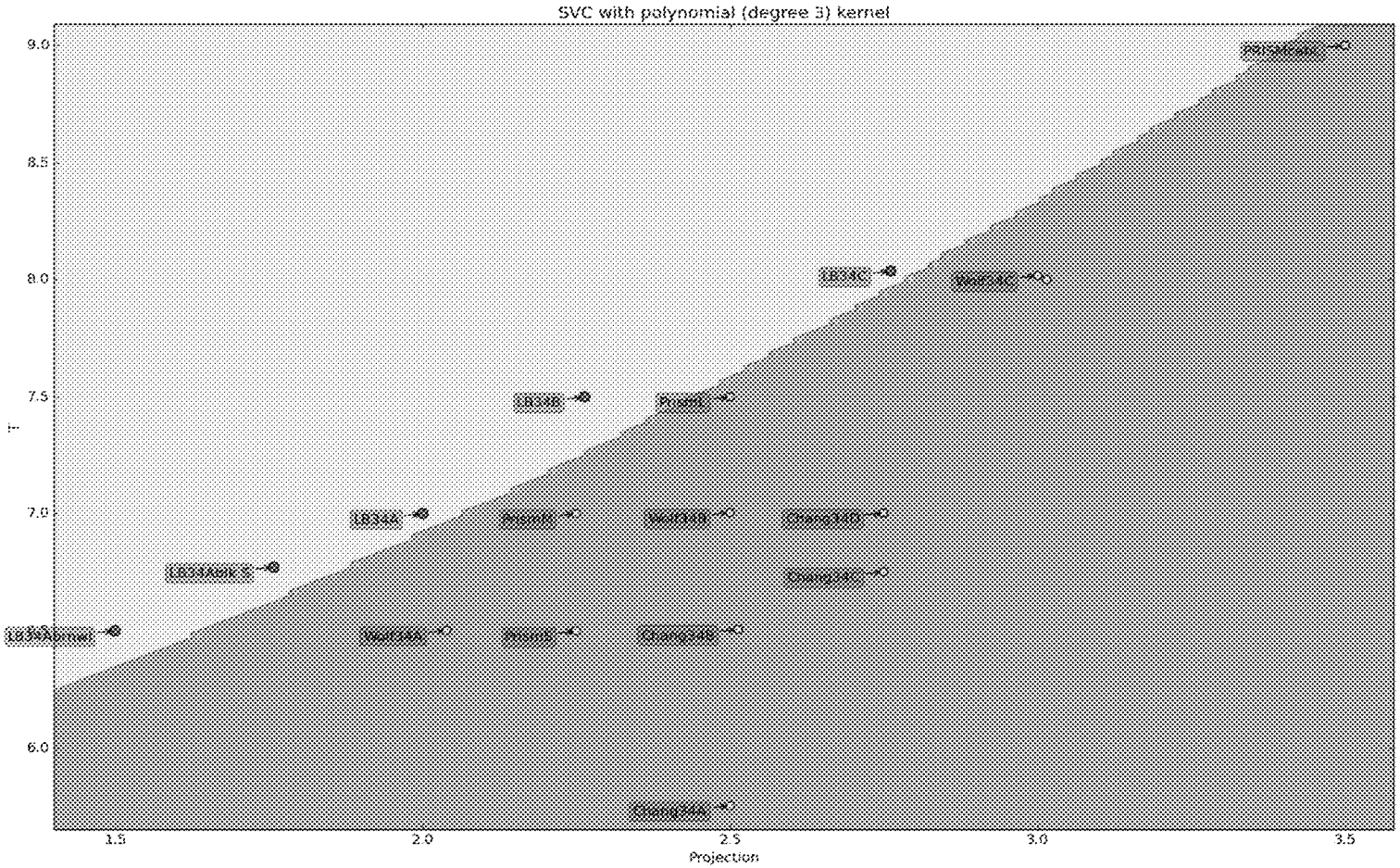
FIG. 25 is Graph 6.
Figure 26:
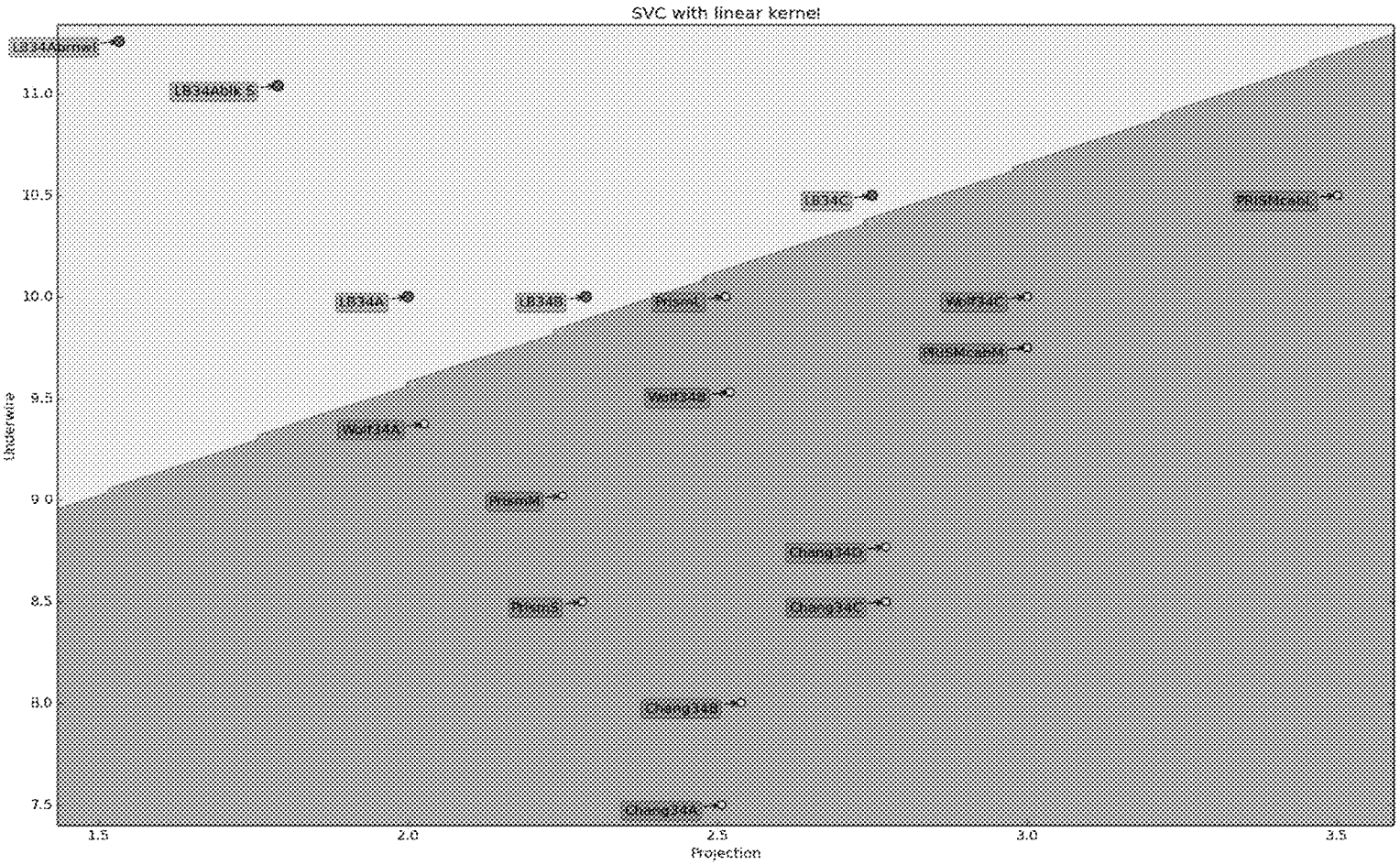
FIG. 26 is Graph 7.
Figure 27:
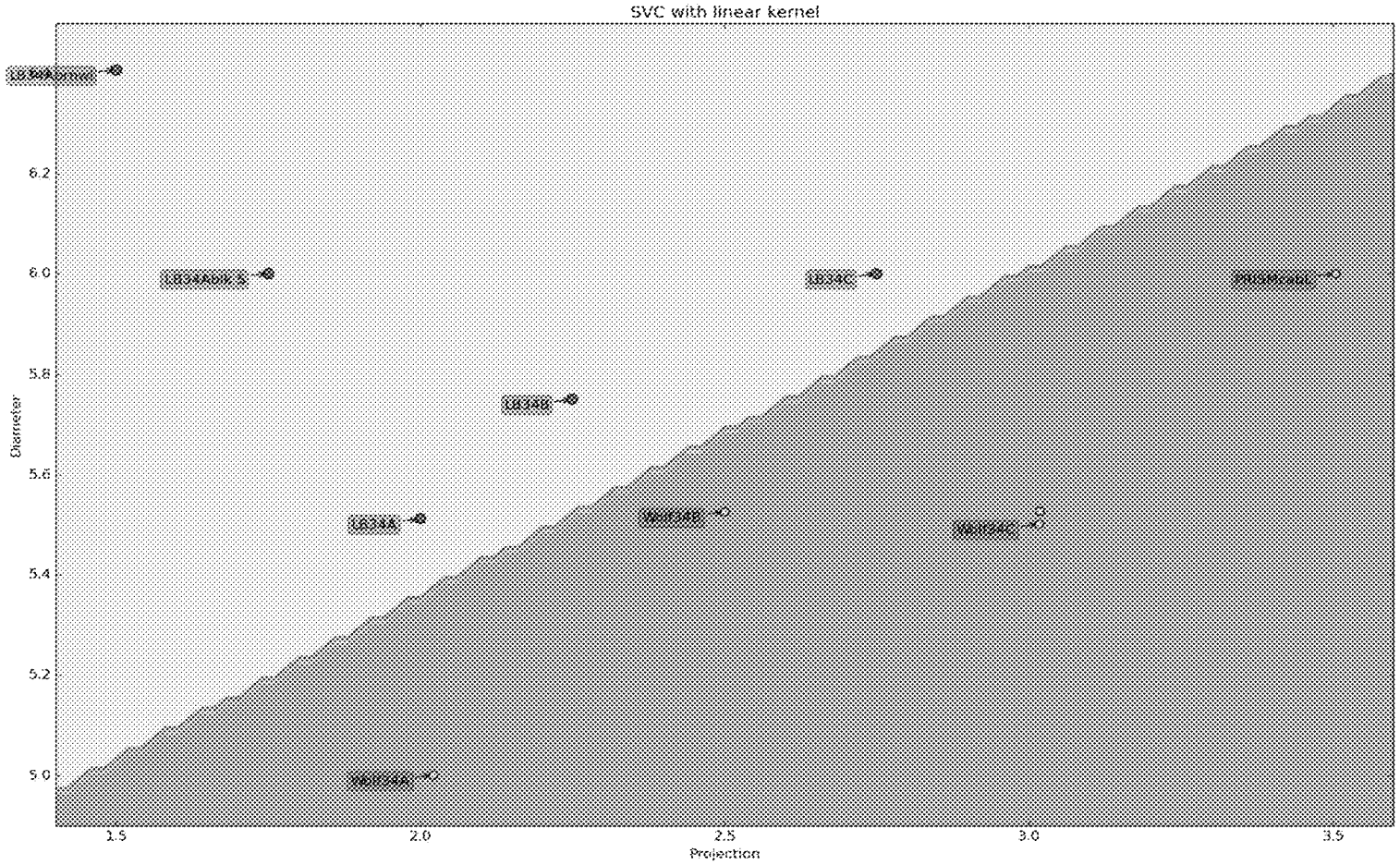
FIG. 27 is Graph 8.
Figure 28:
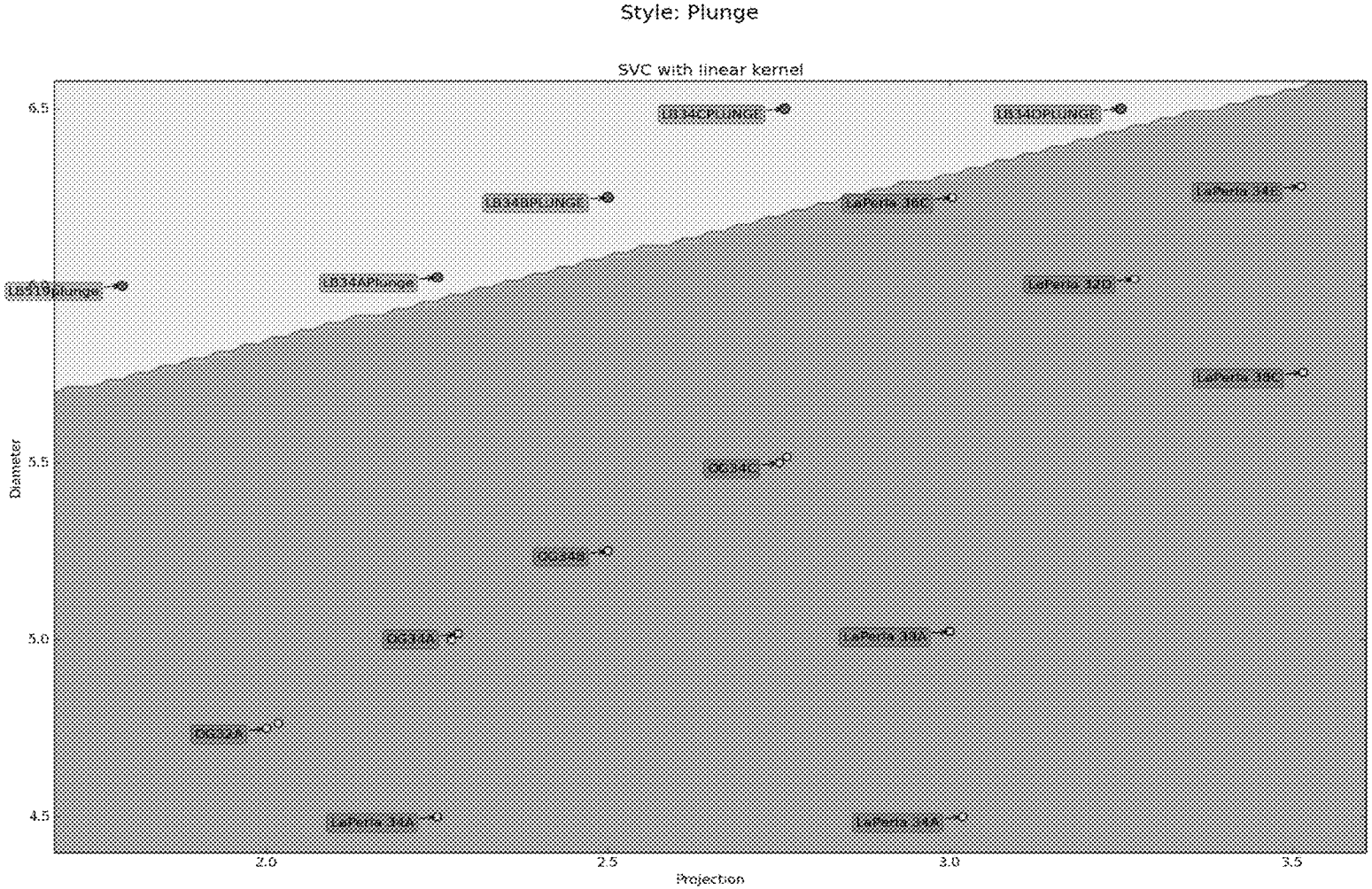
FIG. 28 is Graph 9.
Figure 29:
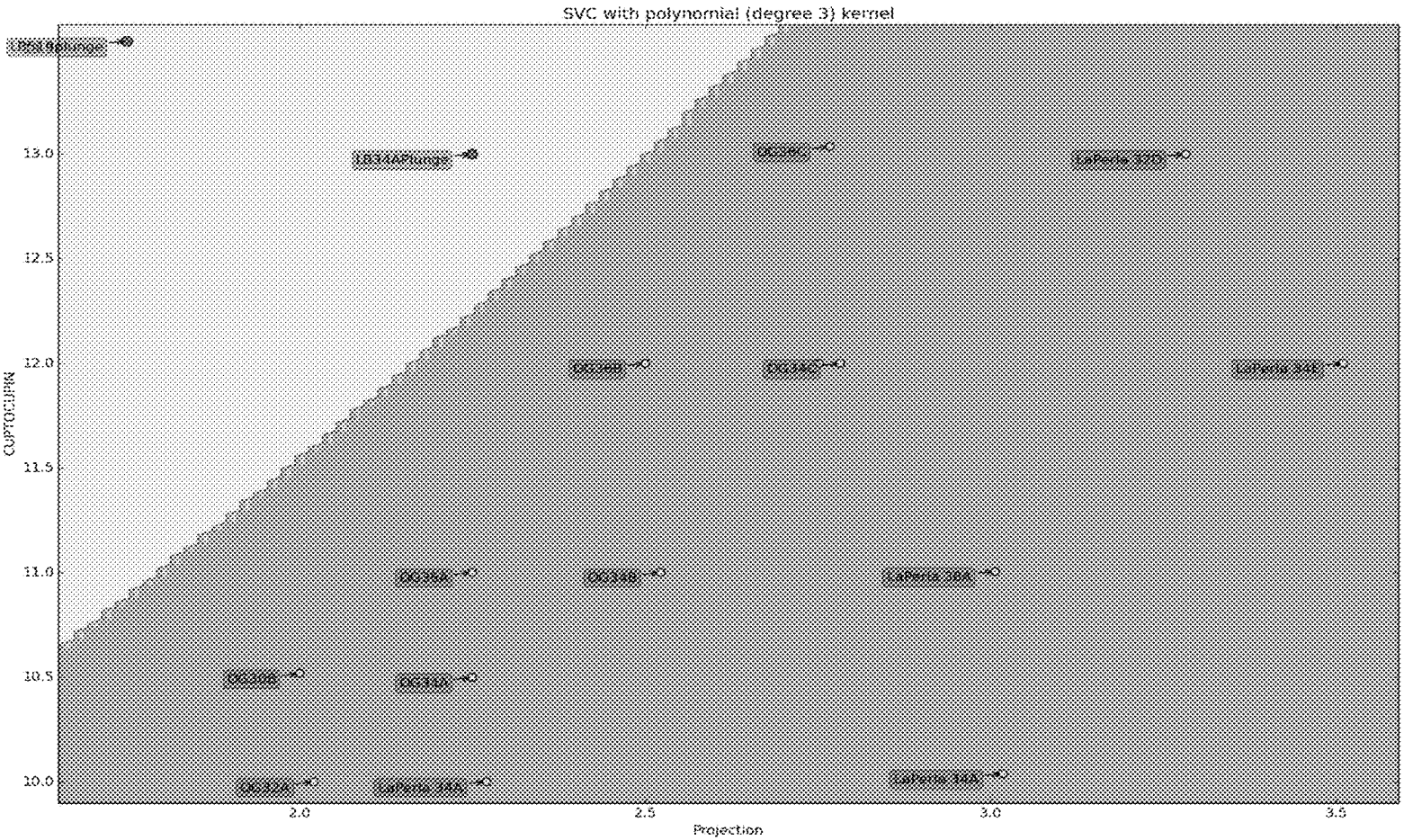
FIG. 29 is Graph 10.
Figure 30:
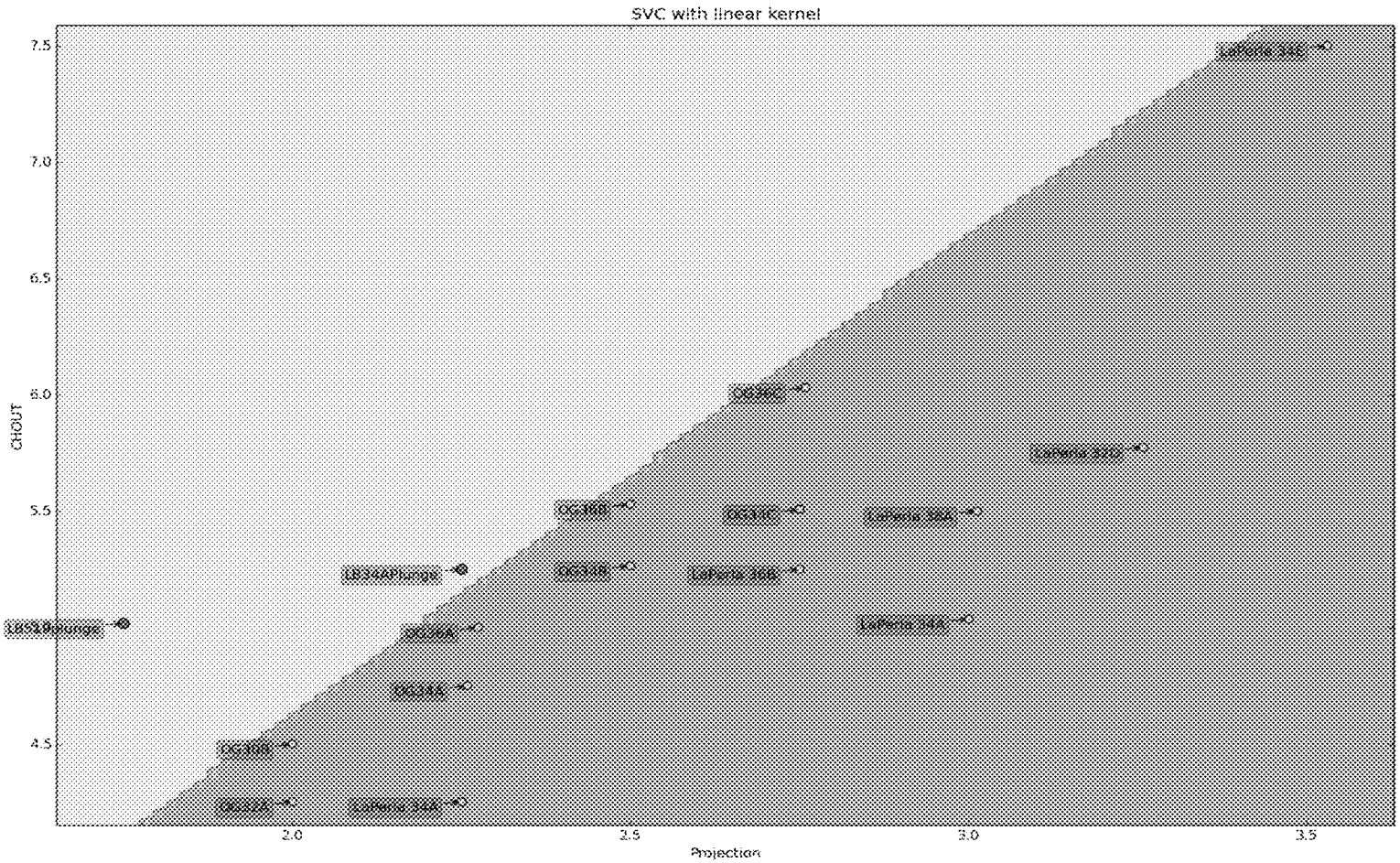
FIG. 30 is Graph 11.
Figure 31:
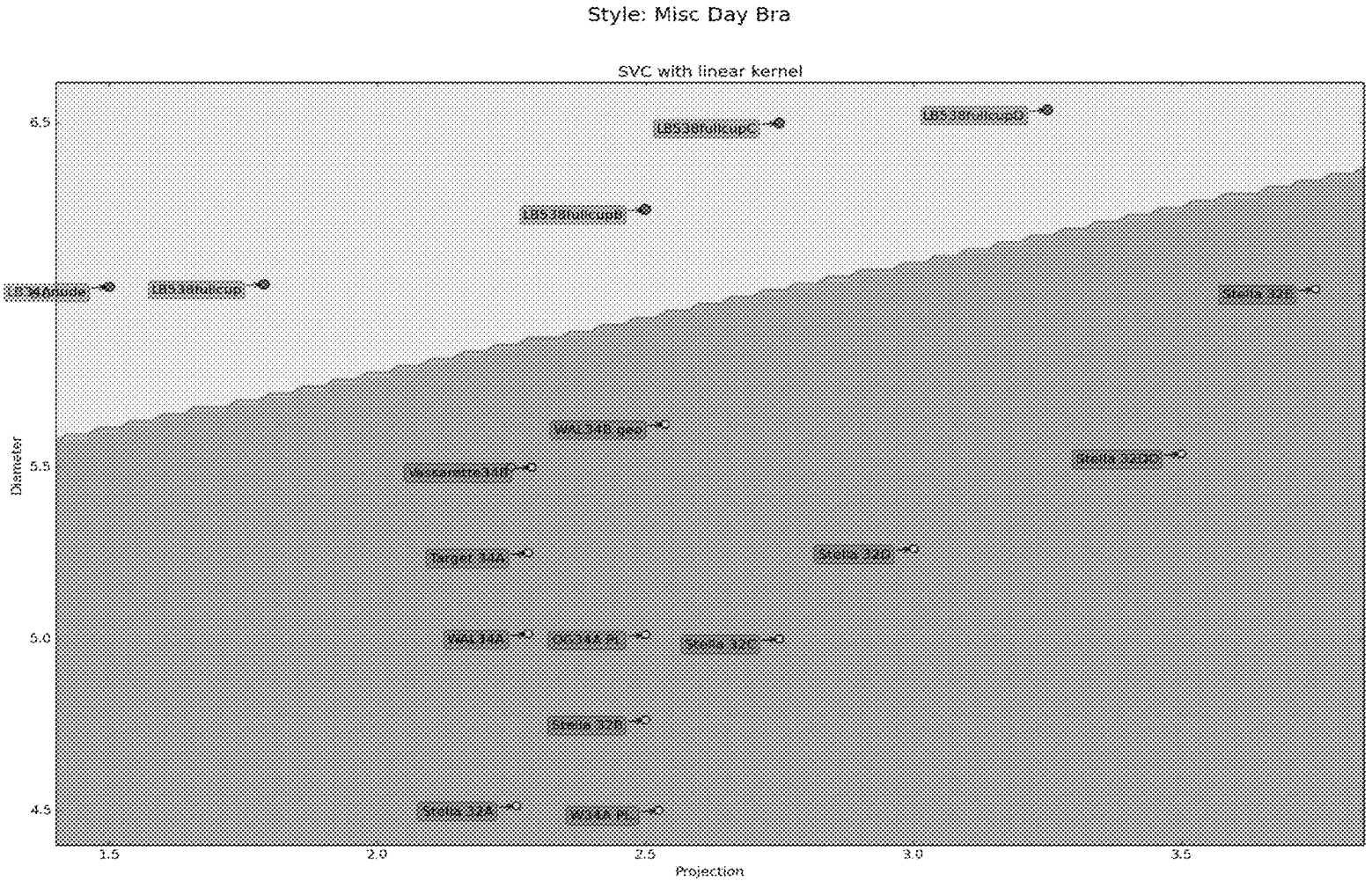
FIG. 31 is Graph 12.
Figure 32:
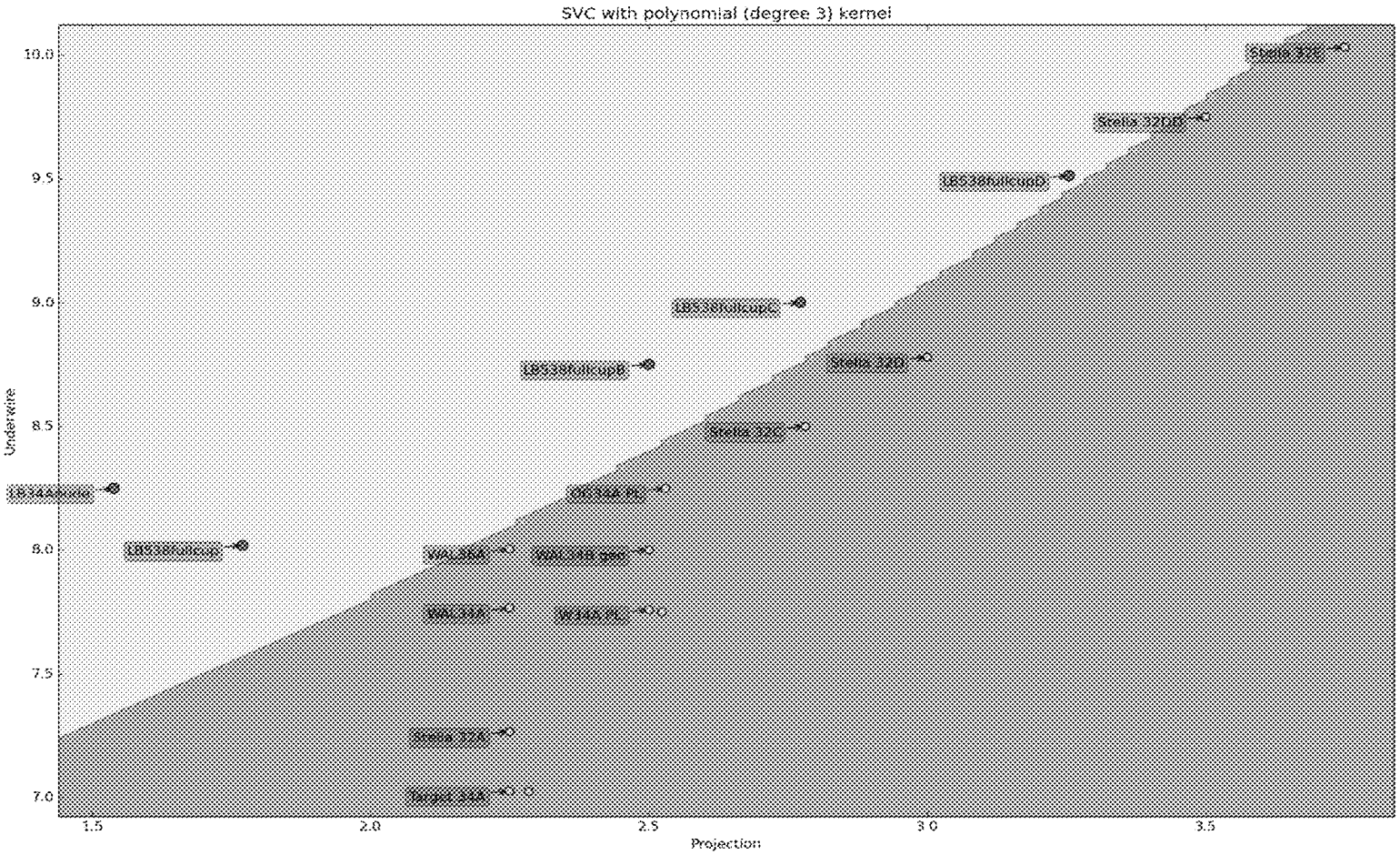
FIG. 32 is Graph 13.
Figure 33:
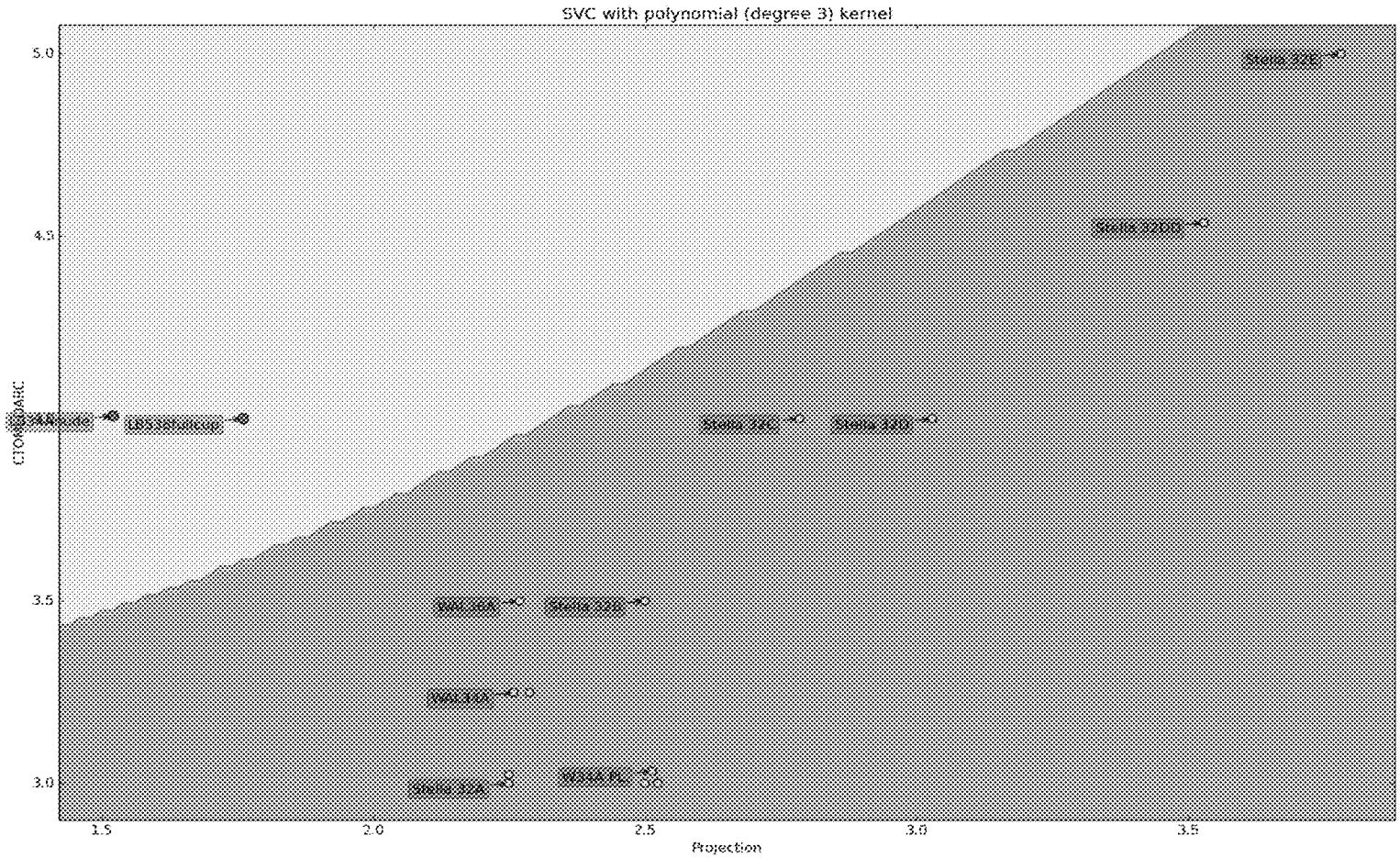
FIG. 33 is Graph 14.
Figure 34:
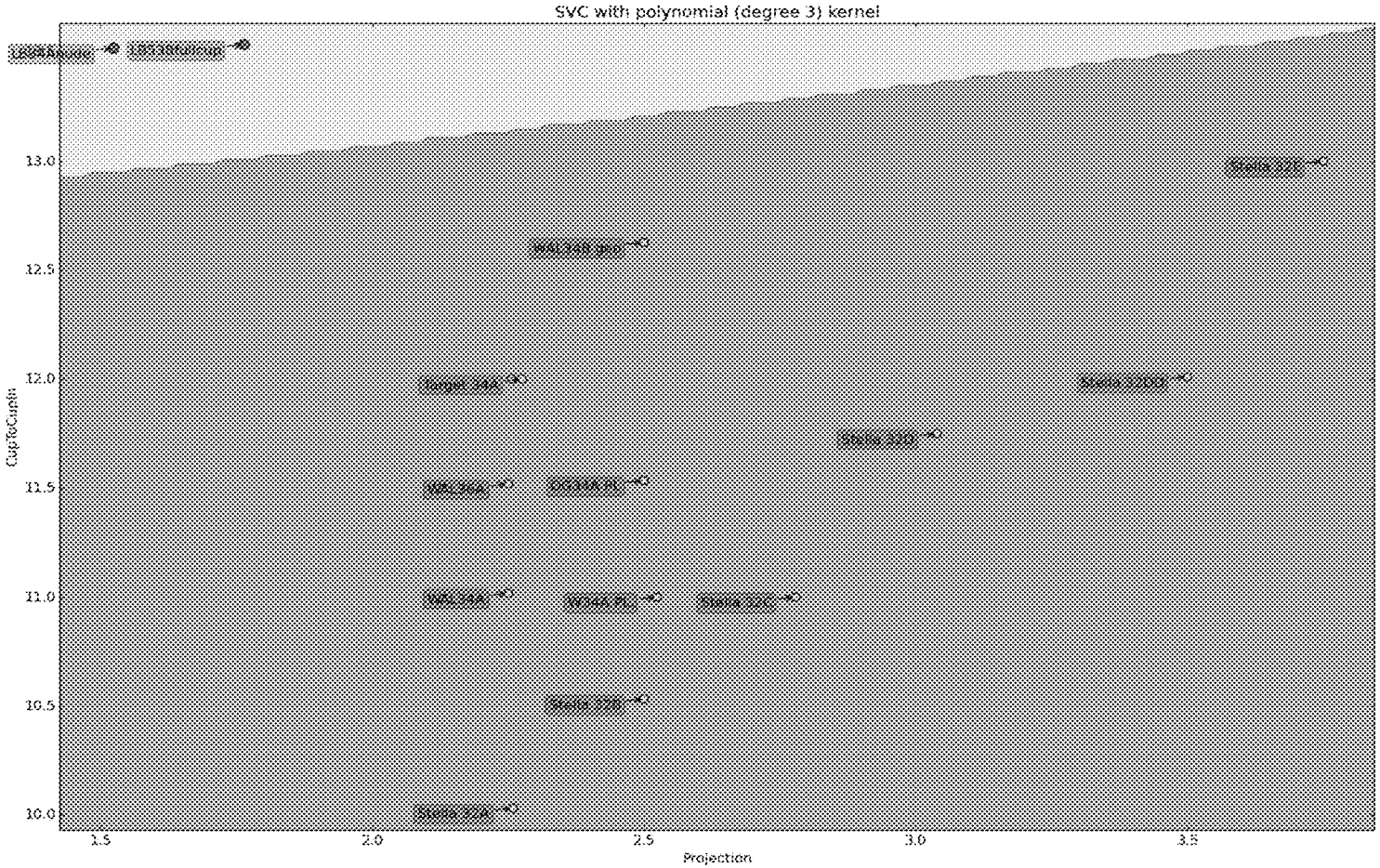
FIG. 34 is Graph 15.
Figure 35:
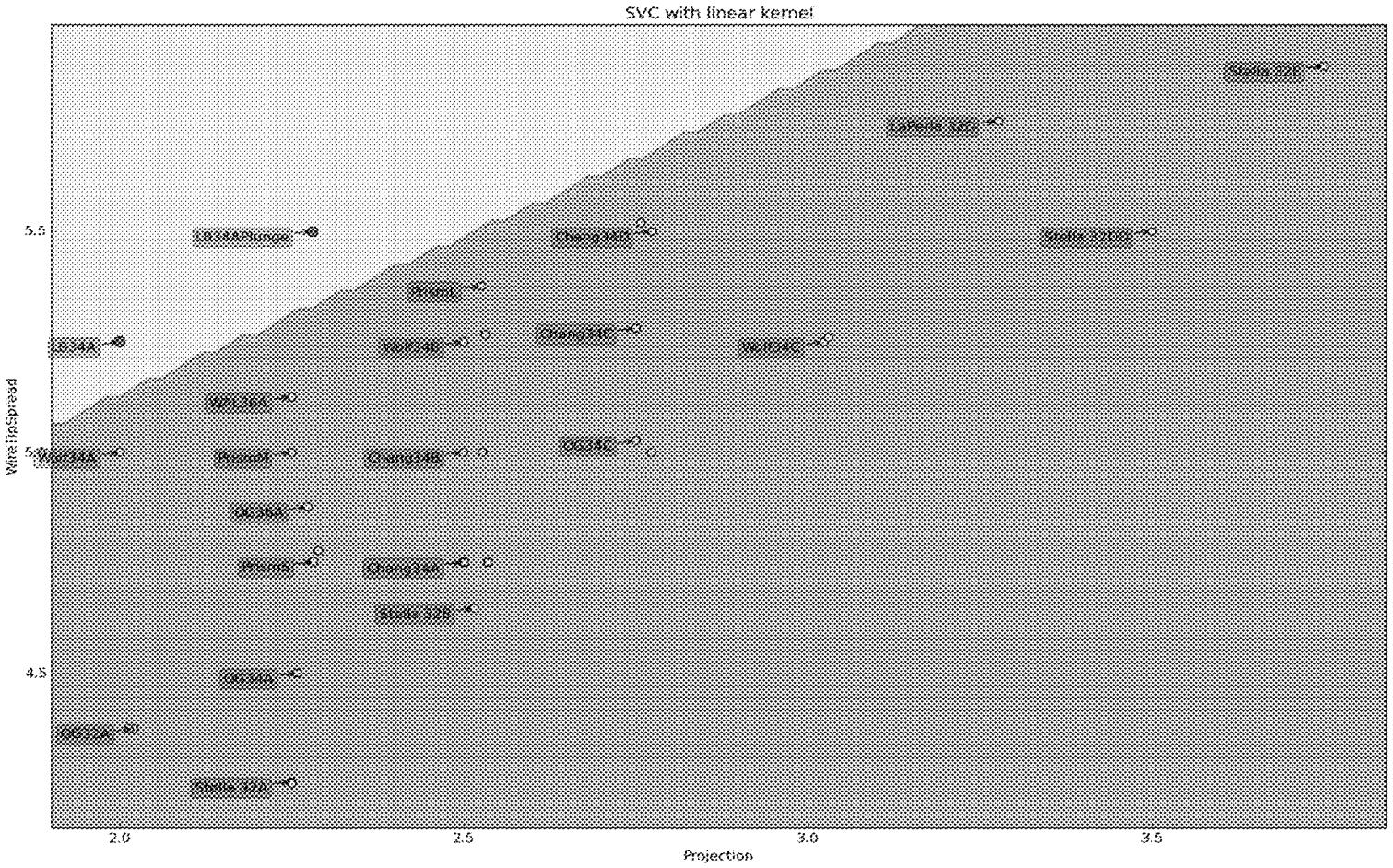
FIG. 35 is Graph 16.
Figure 36:
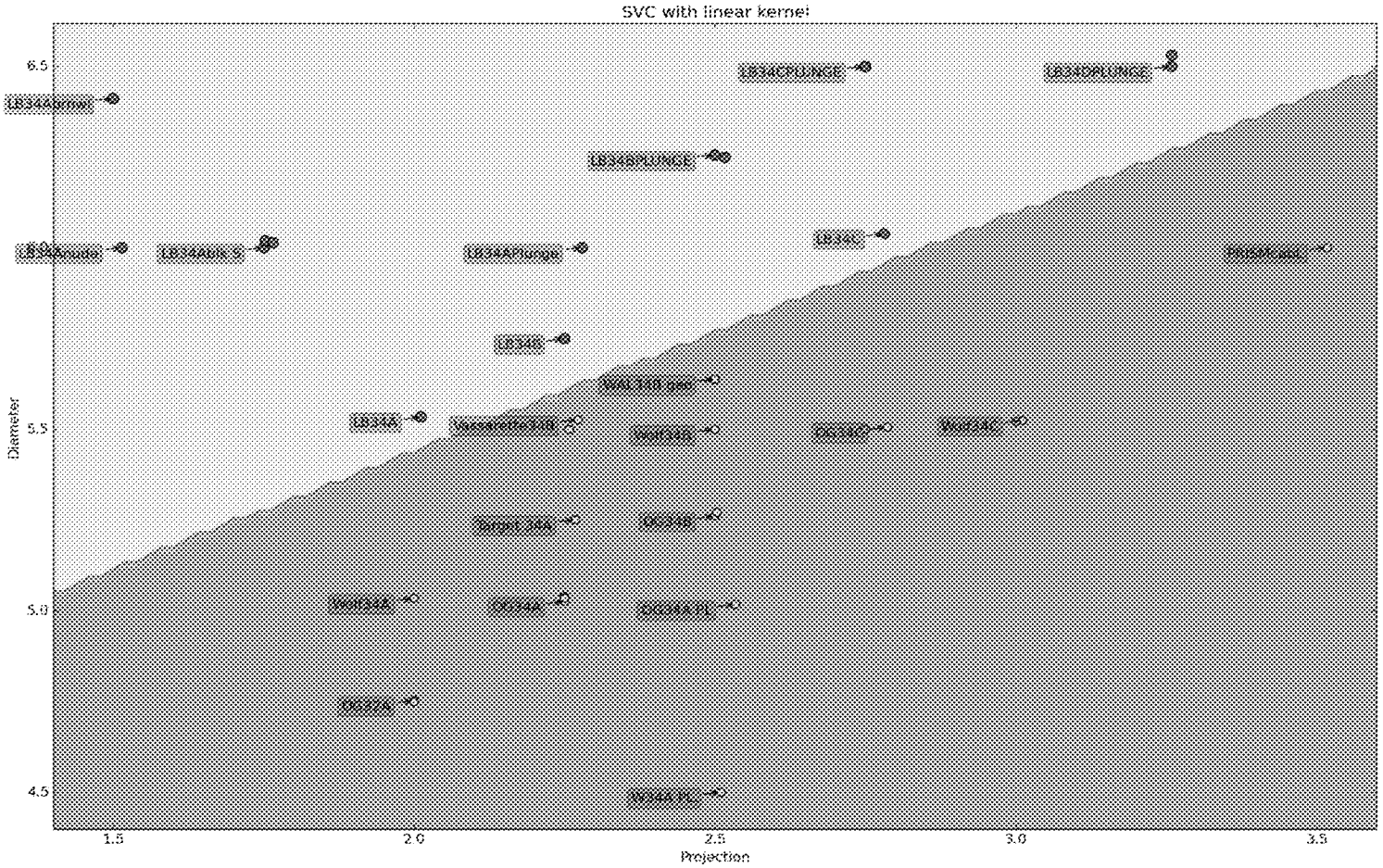
FIG. 36 is Graph 17.
Figure 37:
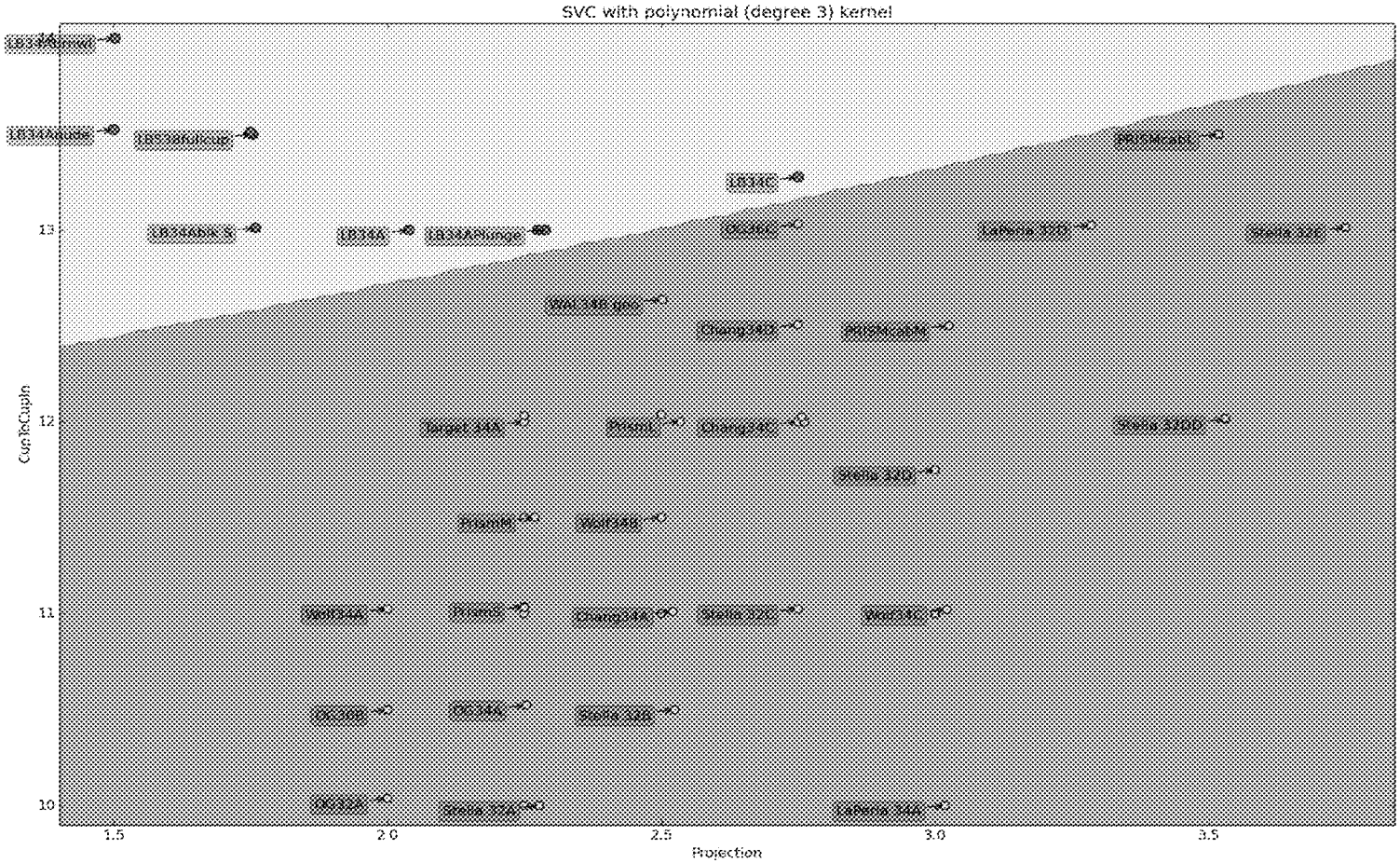
FIG. 37 is Graph 18.

Pressure placed on the inner foam contour by the torso when the bra is tightened to the body supports and lifts up the breast FIG. 9(23A), while also expanding the perimeter of the cup FIG. 15. The inner foam of the inner contour between the inner diameter and the outer diameter pushes the lower perimeter of the outer cup contour out giving the cup an appearance of weight FIG. 12. The inner foam contour between the inframammary fold and the cup perimeter acts as a fulcrum FIG. 3(6) as opposed to prior art which uses the underwire (cup base) at the inframammary fold.

The diameter in industry bra sizing and engineering is designed to fit the breast tissue in a semi-circular shape at the inframammary fold, the breast circumference. The breast tissue and breast perimeter is supported by an underwire or wireless cup, which along with approximately ⅛" wire splay laterally in concert with the band counterforces the bra against the rib cage.

Straps are used to support the bra and lift the weight of the breast tissue.

In the bra of the invention the fill (foam, etc.) using foam like properties surrounds the breast on three sides taking the tension off the breast and cup perimeter. We created a comfortable and well-fitting bra by creating a counterforce between the bust, the cups, and the wings using foam and contours to counterbalance the cups and give the illusion of weight and mass in the cup. Tension engineering was used to make the bra fit comfortably by balancing tension between the bust and the body.

Tension is dispersed by using wider cups (than industry standard per projection) with foam inside the cups counterforcing the thorax FIG. (9). An inner apical zone is created by the inner contour for variations in bust point spread. This is very different from prior art. In prior art the cup is designed for the breast tissue to be positioned inside the cup to an apex.

The website "Her Room" teaches "breast tissue is malleable. For best results, lean forward and place your breasts in your cup making sure your breast apex (nipple) is in the deepest point in your cup before fastening your bra."

In the present invention, using larger diameters than the inframmamary fold standard, and using wider cups positioned on the body between the center line of the body and the mid axillary line, allows the pull of the cups to be spread over a wider distance. The location from under the armpit is a better tension pull point than from the front of the body under the breast.

The pull of the cup from around the mid axillary line allows the gore to sit flat against the sternum which is necessary for proper bra engineering. The fill inside the cup counterforces the torso on three sides of the breast and supports, centers and compacts the breast tissue inside the cup.

Surrounding the breast tissue with foam on three sides and using an inner contour diameter and an outer contour diameter changes the engineering, design and function of the bra.

The inside foam surrounds the breast tissue from three sides and makes it dense.

The breast tissue is contained in the cup in a solid mass surrounded in a material (fill) that compresses and expands as the body moves. The compact breast mound finds a natural center FIG. 7(15) between the cup and the fill. Our cups are designed with a wider base and shallower projection than industry standard. Something with a wide base and a low height, has a low center of gravity in relation to the rest of the object.

The mass of all objects is said to act around one point that is known as the center of gravity. It is around this point that the object can balance, but also where it's weight is exerted downwards.

The bra is designed with an understanding of the flexural modulus of the material, incorporating a constant interplay between a bending stress and the resulting strain.

When the force load is even across the forms geometric center, it is concentric. The tension created between the band, the outer cup and the compression against the inner foam "crown" is it's own counter.

In prior art, the underwire (or seams in a wireless cup perimeter) is the cup stabilizer to the breast, along with the pull of the wings and the support of the straps.

The weight of the breast is supported by the structure of the cup design containing the breast (encapsulation), the stretch of the fabric on the cups (compression), the placement of the cups, the bra design (plunge, day, bandeau etc.), the tension of the band and the tension of the straps.

In bras designed as compression and encapsulation, the weight of the breasts counterforce the cups along with the band around the body.

Bras are designed to fit tight to form to a model breast size based on averages and then are scaled up and down from that form.

The band is designed to have ease using the stretch of the material, the straps are adjustable and the hooks are variable to adjust to the wearers torso.

Fill (foam) is used in the cups acting as a pushing force from the side or the bottom of the cup to create cleavage or to add projection. The perimeter of the fill (foam) is designed within the geometries of the cup perimeter.

Different materials behave differently when subject to compression and tension forces.

The intrinsic quality or strength of material determines the tensile load it can carry.

When it comes to compression, length and cross sectional shape are important.

The shape of an object can affect it's ability to carry compressive forces.

In materials science, the strength of a material is it's ability to withstand an applied load without failure. A load applied to a mechanical member will induce internal forces within the member called stresses, when those forces are expressed on a unit basis. The stresses acting on the material cause deformation of the material in various manner. Deformation of the material is called strain when those deformations too are placed on a unit basis. The applied loads may be axial (tensile or compressive) or shear. To access the load capacity of a member, a complete description of the geometry of the member, it's constraints, the loads applied to the member and the properties of the material of which the member is composed.

The key to quality engineering is a design that will bear load and distribute force in the best way possible. One of the simplest and widely used structures is the arch. The arch is able to reduce shear tension and tortional stress by taking advantage of the compressive force on the arch and making the whole structure stable horizontally. In an arch, the keystone bears the brunt of the force from the mass above it. Force is transferred horizontally along the components of the arch all the way to the supporting abutments, which are positioned securely on the ground. The more compressive force is placed on the keystone, the stronger the arch becomes.

The contours of the cups of this invention support the breasts and the bra using arch technology. The inner contour diameter and the larger outer diameter form an arch.

The "center front" of a bra is like the "keystone" on an arch of a bridge, it holds the bra together and carries the majority of the stress of the bra.

By using a wider diameter than the breast root (inframammary fold) and using foam surrounding the diameter the foam pressing against the rib cage FIG. 3(8) expands and spreads the diameter This is a tremendous solution to cup design because most cups are reliant on breast tissue to fill the cup and spread the wire. If the breast tissue doesn't fill the cup completely, or even if it does it is difficult to spread the wire unless the bust is extremely full. Many women's breast are not dense enough to bring about this action.

When bras are designed they are designed on a model with perfect, full, dense breasts which most women don't have. Most industry bra designs require the breasts to fill the cups completely. Most women do not have breasts as full or "perfect" as the breasts the bras were designed for. There are also many different ways the breasts are positioned on the body which the ready to wear system does not accommodate in it's sizing structure.

The stretch fabric from the outer cup FIG. (11), the pull of the wings FIG. 2(12) laterally FIG. 15 and the wider spread of the larger diameter per volume creates a force against the body The inner foam stretches with the pull of the wings FIG. 15 and expands against the body and also pushes out the cup and the diameter medially, underneath and laterally.

The wider cups and shallower projection per size, allow the tips of the wire cups to spread in a hyperbolic direction and engage in "arch action" FIG. 15.

The inner supportive foam surrounding the diameter pushes against the cup rim using foams expansion to spread the wires The geometries used for the bra cups along with the compressive strength of the foams properties create a new form of breast containment and engineering.

As the center front is pushed downwards by the load above it, (the breast and foam) it's curve pushes outward onto the arch. The forces are spread sideways, rather than downwards, and thence around the arch. Ultimately the entire load is transferred partly down and partly out to either side of the center.

In this application the outer cup/inner cup "diameter to projection" ratio is different from industry standard and industry engineering. Because of that, all geometries, curves and contours are different from industry bras.

By altering the dimensions of the "pad" or cup, the perimeter is less circular.

The lower curve is similar to an oblate spheroid. In an embodiment using a molded cup the inner contour is formed using opposing inner concave and outer convex curves.

When the pad, is inserted into a bra frame (and or underwire), the interaction between the bra frame or underwire prestresses the cup. The combination between the pad and the frame and between the pad contours and the body, forms an intrinsic property that varies depending on the level of fill, density, the pad shape, the contour shape, the volume of the breast, and the angle of the ribcage.

The prestressed cup has a force of its own using the interaction of the foams properties, the interior curve against exterior curve and the cup or underwire and bra frame geometry. In an embodiment, the concave fill (foam) on the inside of the cup pushes against the concave fill on the exterior of the cup. The interior and exterior shape of the bra cup is formed by this action. The curve of the breast starting from the inframammary fold to the apical zone compresses the inner contour causing a reverse curve to secure the foam to the torso FIG. 15 and the foam against the breast. The interior shape is pushed out by the interaction between the torso and the breast thus pushing out the exterior contour of the cup FIG. 14. The bra cup is less reliant on the breast to fill out the shape of the cup. This is a very important feature particularly for breasts that do not match the breasts of the initial core model size and do not fill out a bra cup size completely. The cup and bra move in concert with the torso and the breast, bra, cups and torso work in a biomechanical unity.

When the bra is put on the body due to the new geometries of this invention, several unique things happen within the bra cup.

Figure 8:
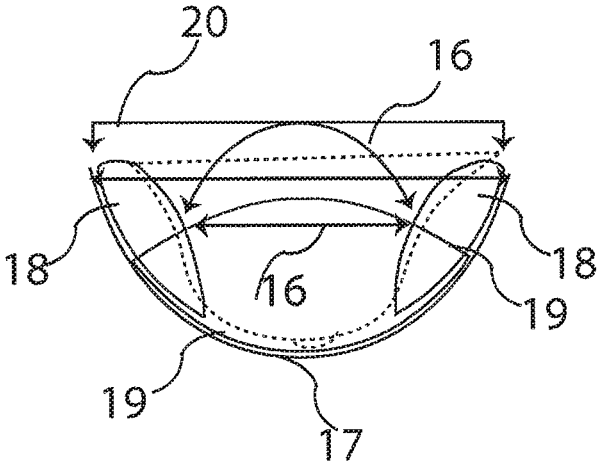
FIG. 8 is a schematic diagram of an embodiment of a cup of the invention showing the position of the breast inside the cup.

The foams (fill) properties inside the cup make the breast tissue dense from three sides FIG. 8. The inner foam contour manipulates the mass and supports the inner volume and inframammary fold inside the cup FIG. 9(21A). This is very different from industry standard using the inframammary fold as the perimeter of the cup.

Figure 10:
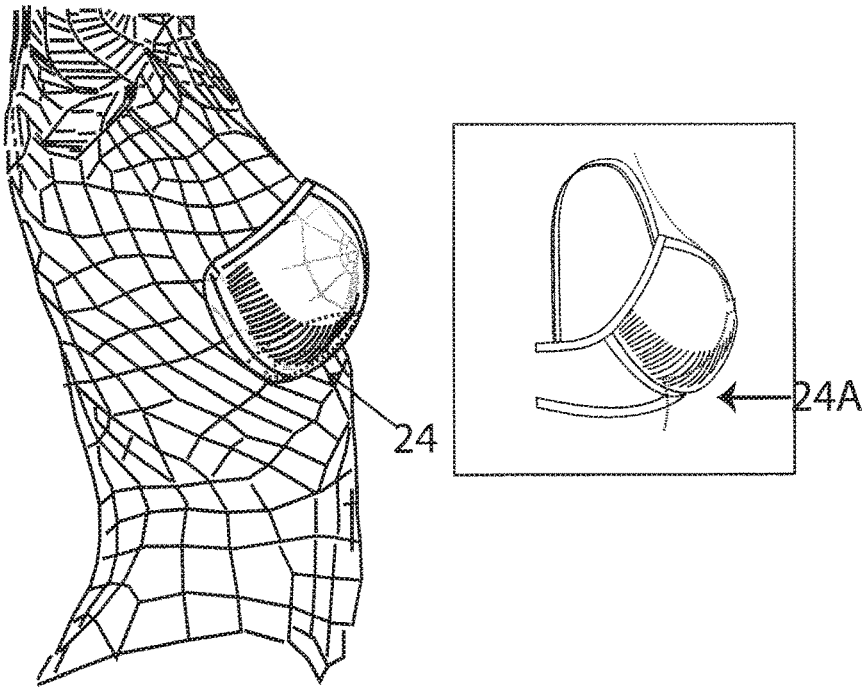
FIG. 10 is a side view of a cup according to an embodiment of FIG. 1 of the present invention showing an outside view of the cup on a body frame.
Figure 11:
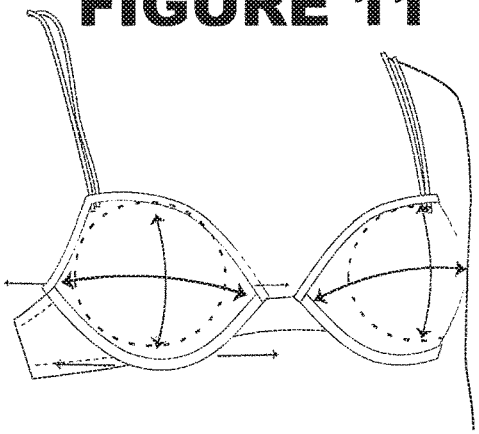
FIG. 11 is a front perspective view of a brassiere according to an embodiment of the present invention, showing an outside view of the brassiere.

Positioning the inframammary fold inside the cup using the foam contour as support along with the stretch of the cup from the pull of the wings on the body when worn supports and lifts the breast tissue FIG. 10(24A). The pulling force on the interior foam also pushes the foam against the thorax. This action causes a reverse curve inside the cup with the interior (fill) foam.

The outside contour with a wider curve than the interior contour supports the reverse curve with fill creating a wedge between the reverse curve and the exterior contour FIG. 10(24A).

The inner contour acts very differently from the outer contour.

The spring line of the arch is equivalent to the diameter of the cup base measured from the top of the cup arc medially to the top of the cup arc laterally. In prior art, the underwire, or wireless cup is designed to spring (expand) approximately ⅙" from the lateral side to allow the bra to adjust to the breast and the body. This action is reliant on the pull from the wings and the weight of the breast against the underwire (or wireless cup). If the band is not tight enough or the breast tissue does not fill out the cup this action will not engage.

The "springing" in the bra of the invention is caused by the interaction of the tension between the inner contour and the outer underwire (or cradle cup) pulled tight on the torso. It is not necessarily reliant on the breast tissue. The cup is prestressed by the foam and the contours on all sides (medially, underneath and laterally) eliminating much of the need for the breast and ribcage to stress the cups. This is a great advantage over prior art.

Many breasts are asymmetrical or do not match the breast volume of the original fit model. Since prior art bras are designed to interact with the tension and weight of the breast it is very important for the tissue to fill out the cup completely to have the bra fit comfortably. If the breast tissue doesn't fill the cup completely, the bra will not work properly and all other functions of the bra will not work properly.

The invention claimed is:

1. A brassiere, comprising:

a first wing and a second wing, each wing including a first end and a second end;

a pair of prestressed cups, a first cup connected to the second end of the first wing, and a second cup connected to the second end of the second wing;

each cup including an inner contour having a diameter size;

each cup including an outer contour having an outer diameter defined by an outer diameter size, and an outer apex having a projection distance from a plane of the outer diameter;

filling material provided between the inner contour and the outer contour and being located on each cup so as to, when the brassiere is worn, press against the rib cage and expand and spread the outer diameter;

a gore connected to each of the first cup and the second cup; and wherein:

the diameter size is between 5.5 and 6 inches and the projection distance has a value that falls within an area above a boundary line in Graph 18.

2. A brassiere, comprising:

a first wing and a second wing, each wing including a first end and a second end;

a pair of prestressed cups, a first cup connected to the second end of the first wing, and a second cup connected to the second end of the second wing;

each cup including an inner contour having a diameter size;

each cup including an outer contour having an outer diameter defined by an outer diameter size, and an outer apex having a projection distance from the outer diameter;

filling material provided between the inner contour and the outer contour and being located on each cup so as to, when the brassiere is worn, press against the rib cage and expand and spread the outer diameter;

a gore connected to each of the first cup and the second cup; and wherein for a cup-to-cup range of more than 12 inches and less than 14 inches:

the diameter size and the projection distance have values that satisfy an equation as follows:

$$y=0.69x+11.24,$$

where y=the diameter size, and x=the projection distance.

3. A brassiere, comprising:

a first wing and a second wing, each wing including a first end and a second end;

a pair of prestressed cups, a first cup connected to the second end of the first wing, and a second cup connected to the second end of the second wing;

each cup including an inner contour having a diameter size;

each cup including an outer contour having an outer diameter defined by an outer diameter size, and an outer apex having a projection distance from a plane of the outer diameter;

filling material provided between the inner contour and the outer contour and being located on each cup so as to, when the brassiere is worn, press against the rib cage and expand and spread the outer diameter;

a gore connected to each of the first cup and the second cup; and wherein:

the diameter size and the projection distance have values that fall within an area above a boundary line in Graph 17.

4. A brassiere, comprising:

a first wing and a second wing, each wing including a first end and a second end;

a pair of prestressed cups, a first cup connected to the second end of the first wing, and a second cup connected to the second end of the second wing;

each cup including an inner contour having a diameter size;

each cup including an outer contour having an outer diameter defined by an outer diameter size, and an outer apex having a projection distance from the outer diameter;

filling material provided between the inner contour and the outer contour and being located on each cup so as to, when the brassiere is worn, press against the rib cage and expand and spread the outer diameter;

a gore connected to each of the first cup and the second cup; and wherein for the diameter size within a range of 5 and 7 inches:

the diameter size and the projection distance have values that satisfy an equation as follows:

$$y=0.68x+-4.08,$$

where y==the diameter size, and x=the projection distance.

5. A brassiere, comprising:

a first wing and a second wing, each wing including a first end and a second end;

a pair of prestress cups, a first cup connected to the second end of the first wing, and a second cup connected to the second end of the second wing;

each cup including an inner contour having a diameter size;

each cup including an outer contour having an outer diameter defined by an outer diameter size, and an outer apex having a projection distance from the plane of the outer diameter;

filling material provided between the inner contour and the outer contour and king located on each cup so as to, when the brassiere is worn, press against the rib cage and expand and spread the outer diameter;

a gore connected to each of the first cup and the second cup; and wherein:

each cup has a center to medial arc value of between 4 and 6 inches, and wherein the center to medial arc value and the projection distance have values located in an area above a boundary line in Graph 3.

6. A brassiere, comprising:

a first wing and a second wing, each wing including a first end and a second end;

a pair of prestressed cups, a first cup connected to the second end of the first wing, and a second cup connected to the second end of the second wing;

each cup including an inner contour having a diameter size;

each cup including an outer contour having an outer diameter defined by an outer diameter size, and an outer apex having a projection distance from the outer diameter;

filling material provided between the inner contour and the outer contour and being located on each cup so as to, when the brassiere is worn, press against the rib cage and expand and spread the outer diameter;

a gore connected to each of the first cup and the second cup; and wherein for a center to medial are value range of between 4 and 6 inches:

the diameter size and the projection distance have values that satisfy an equation as follows:

$$y=1.76x+0.79,$$

where y=the diameter size, and x=the projection distance.

* * * * *